US005796844A

United States Patent [19]

Griesinger

[11] Patent Number: 5,796,844

[45] Date of Patent: Aug. 18, 1998

[54] MULTICHANNEL ACTIVE MATRIX SOUND REPRODUCTION WITH MAXIMUM LATERAL SEPARATION

[75] Inventor: David H. Griesinger, Cambridge, Mass.

[73] Assignee: Lexicon, Bedford, Mass.

[21] Appl. No.: 684,948

[22] Filed: Jul. 19, 1996

[51] Int. Cl.[6] ..... H04S 3/00

[52] U.S. Cl. ..... 381/18; 381/22; 381/23

[58] Field of Search ..... 381/18, 19, 20, 381/21, 22, 23

[56] References Cited

U.S. PATENT DOCUMENTS

| | | |
|---|---|---|
| 3,626,365 | 12/1971 | Press . |
| 3,772,479 | 11/1973 | Hilbert . |
| 3,786,193 | 1/1974 | Tsurushima . |
| 3,798,373 | 3/1974 | Bauer . |
| 3,812,295 | 5/1974 | Bauer . |
| 3,825,684 | 7/1974 | Ite . |
| 3,829,615 | 8/1974 | Hiramatsu . |
| 3,836,715 | 9/1974 | Ite . |
| 3,934,086 | 1/1976 | Takahashi . |
| 3,944,735 | 3/1976 | Willcocks . |
| 3,959,590 | 5/1976 | Scheiber . |
| 4,027,101 | 5/1977 | DeFreitas . |
| 4,074,083 | 2/1978 | Berkovitz . |
| 4,135,203 | 1/1979 | Friedman . |
| 4,236,039 | 11/1980 | Cooper . |
| 4,361,727 | 11/1982 | Franssen et al. . |

(List continued on next page.)

FOREIGN PATENT DOCUMENTS

| | | |
|---|---|---|
| 335468 | 10/1989 | European Pat. Off. . |
| 1112233 | 5/1968 | Germany . |
| 138267 | 10/1979 | Germany . |
| 138266 | 10/1989 | Germany . |
| 0050200 | 3/1982 | Japan . |
| WO8909465 | 10/1989 | WIPO . |

OTHER PUBLICATIONS

Julstrom, "A High Performance Surround Sound Process For Home Video", J. Audio. Eng. Soc., vol. 35, No. 7/8, 1987, pp. 536–549.

Griesinger, David, "Practical Processors and Programs for Digital Reverberation. AES 7th International Conference", Mar., 1989, pp. 187–195.

Krokstad, Asbjern, "Electroacoustic Means of Controlling Auditorium Acoustics", Sep. 1985, pp. 1–18.

Ahnert, Wolfgang, "The Complex Simulation of Acoustical Sound Fields by the Delta Stereophony System DDS" 2418 (D–16), Nov. 1986, pp. 1–26.

Berkhout, A.J., "A Holographic Approach to Acoustic Control, J. Audio Eng. Soc.", vol. 36, No. 12, Dec., 1988.

*Primary Examiner*—Forester W. Isen

*Attorney, Agent, or Firm*—Haynes and Boone, L.L.P.

[57] ABSTRACT

A sound reproduction system for converting stereo signals on two input channels, which may have been directionally encoded from a four or five channel original using a phase/amplitude film matrix encoder, such signals including at least one component which is directionally encoded through a phase and amplitude encoding device and at least one component that is not directionally encoded but is different in the two input channels, into signals for multiple output channels, for example center, front left, front right, side left, side right, rear left, and rear right, including decoding apparatus for enhancing the directionally encoded component of the input signals in the desired direction and reducing the strength of such signals in channels not associated with the encoded direction, while preserving both the maximum separation between the respective left and right channels and the total energy of the non-directionally encoded component of the input channels in each output channel, such that the instruments recorded on the right input channel stay on the right side of the output channels and the instruments recorded on the left stay on the left side, and the apparent loudness of all the instruments in all the output channels stays the same regardless of the direction of the directionally encoded component of the input signals.

24 Claims, 9 Drawing Sheets

U.S. PATENT DOCUMENTS 4,618,987 10/1986 Steinke .
4,649,564 3/1987 Barnett .
4,704,728 11/1987 Scheiber .
4,862,502 8/1989 Griesinger .
4,891,839 1/1990 Scheiber .
4,955,057 9/1990 Tominari .
5,029,216 7/1991 Jhabvala et al. .
5,109,419 4/1992 Griesinger .
5,136,650 8/1992 Griesinger .
5,161,197 11/1992 Griesinger .

MULTICHANNEL ACTIVE MATRIX SOUND REPRODUCTION WITH MAXIMUM LATERAL SEPARATION

FIELD OF THE INVENTION

This invention relates to sound reproduction systems involving the decoding of a stereophonic pair of input audio signals into a multiplicity of output signals for reproduction after suitable amplification through a like plurality of loudspeakers arranged to surround a listener.

More particularly, the invention concerns a set of design criteria and their solution to create a decoding matrix having optimum psychoacoustic performance, with high separation between left and right components of the stereo signals while maintaining non-directionally encoded components at a constant acoustic level regardless of the direction of directionally encoded components of the input audio signals.

Additionally, this invention relates to the encoding of multi-channel sound onto two channels for reproduction by decoders according to the invention.

BACKGROUND OF THE INVENTION

Apparatus for decoding a stereophonic pair of left and right input audio signals into a multiplicity of output signals is commonly referred to as a surround sound decoder or processor. Surround sound decoders work by combining the left and right input audio signals in different proportions to produce the multiplicity N of output signals. The various combinations of the input audio signals may be mathematically described in terms of a N row by 2 column matrix, in which there are 2N coefficients each relating the proportion of either left or right input audio signals contained in a particular output signal.

The matrix coefficients may be fixed, in which case the matrix is called passive, or they may vary in time in a manner defined by one or more control signals, in which case the matrix is described as active. The coefficients in a decoding matrix may be real or complex. Complex coefficients in practice involve the use of precise phase quadrature networks, which are expensive, and therefore most recent surround sound decoders do not include them, so that all of the matrix coefficients are real. In the bulk of the work described in this patent application, the matrix elements are also real. Real coefficients are inexpensive and will optimally decode a five channel film encoded with the active encoder described in this patent.

However, real coefficients are not optimal when decoding a film encoded from a five channel original using a passive encoder such as the one described in this application, and are also not optimal when decoding a film made with the standard four channel encoder of the prior art. A modification to the decoder design which will optimally decode such films is also described. Although the description is of a phase corrector to the inputs of the decoder, the correction could also be accomplished by making the matrix elements complex.

In a passive matrix, which is defined as a matrix in which the coefficients are constant, such as the Dolby Surround matrix, several ideal properties are achieved by suitable choice of the coefficients. These properties include the following:

Signals encoded with a standard encoder will be reproduced by a passive matrix decoder with equal loudness regardless of their encoded direction.

Signals where there is no specific encoded direction, such as music that has been recorded so that the two inputs to the decoder have no correlation, that is, decor related signals, will be reproduced with equal loudness in all output channels.

When the input signals are a combination of a directionally encoded component and a decor related component there is no change in either the loudness or the apparent separation of the decor related component as the encoded direction of the directionally encoded component changes.

A disadvantage of passive decoders is that the separation of both directional and decor related components of the input signals is not optimal. For example, a signal intended to come from front center is also reproduced in the left and right front output channels usually with a level difference of only 3 dB. Therefore, most modern decoders employ some variation of the matrix coefficients with the apparent direction of the predominant sound source, that is, they are active rather than passive.

In the original Dolby Surround decoder format, only one rear channel output is provided, which typically is reproduced on more than one loudspeaker, all such loudspeakers being driven in parallel, so that there is no left-right separation in the rear channels. However, there is high separation between signals that are encoded in opposite directions.

Previous patents have described many aspects of active matrix surround sound decoders for conversion of a stereophonic audio signal pair into multiple output signals. The prior art describes how the apparent direction of a directionally encoded signal component can be determined from the logarithm of the ratio of the amplitudes of the component in the left and right channels of the stereophonic pair, along with the logarithm of the ratio between the sum of these amplitudes and the difference therebetween. This art will be assumed in this patent application, along with a great deal of art which pertains to smoothing the directional control signals thus or otherwise derived. We assume that these two directional control signals exist in a useable form. For the purposes of this invention, these directional control signals can be possibly derived from directional information recorded on a subchannel of a digital audio signal.

This invention concerns the use to which these directional control signals are put in controlling an active matrix which takes the signals on the two inputs and distributes them to a number of output channels in appropriately varying proportions dependent upon the directional control signals.

A simple example of such a matrix is given by Scheiber in U.S. Pat. No. 3,959,590. Another matrix in common use is that of Mandell, described in U.S. Pat. No. 5,046,098. A matrix with four outputs is described in detail in Greisinger, U.S. Pat. No. 4,862,502, and a complete mathematical description of this matrix, along with a mathematical description of a six output matrix, is given in Greisinger, U.S. Pat. No. 5,136,650. A different six output matrix is described in Fosgate, U.S. Pat. No. 5,307,415. All of these prior matrices distribute the input audio signals among the various outputs under control of the directional control signals as described above.

Each of these matrices is constructed somewhat differently, but in each case each output is formed by a sum of the two input signals, each input signal having been first multiplied by a coefficient. Thus each matrix in the prior art can be completely specified by knowing the value of two coefficients for each output and how these coefficients vary as a function of the directional control signals which provide directional information as described above. These two coefficients are the matrix elements of a N by 2 matrix, where N is the number of output channels, which completely specifies the character of the decoder. In most prior art these matrix elements are not explicitly stated, but can be inferred from the descriptions given. In a particular embodiment they can also be easily measured.

Greisinger, U.S. Pat. No. 5,136,650, issued Aug. 4, 1992, gives the complete functional dependence of each matrix element on the directional control signals.

Since the above-referenced Greisinger patent issued, the film industry has developed a "five plus one" discrete sound standard. Many theater movie releases and some home releases are made with soundtracks comprising five separate full bandwidth audio channels, namely center, left front, right front, left rear, and right rear, with a reduced bandwidth sixth audio channel intended for very low frequency effects. Reproduction of such soundtracks requires special digital hardware to demultiplex and decompress the audio tracks into the 5+1 output channels. However, there is a very large selection of previously released film prints and videos which employ a two channel soundtrack matrix encoded format, both analog and digital. Such soundtracks are encoded during the mixing process using a standardized four channel to two channel encoder.

While earlier work by Greisinger and others has described the outputs of the decoder in terms of a complicated sum of various signals: the input signals, their sum and their difference, and the same four signals after passing through variable gain amplifiers controlled by the directional control signals, it is possible to collect the terms of each output that are related to a particular input and thereby to describe the matrix completely in closed form, so that the decoder can be realized either in digital or analog hardware components.

The standard encoder for two channel soundtrack matrix encoding has limitations, and an improved passive encoder or an active encoder can be used to generate two channel matrix encoded soundtracks that achieve better performance when decoded through a surround sound decoder according to the invention.

SUMMARY OF THE INVENTION

The present invention is concerned with realization of the active matrix having certain properties which optimize its psychoacoustic performance.

The invention is a surround sound decoder having variable matrix values so constructed as to reduce directionally encoded audio components in outputs which are not directly involved in reproducing them in the intended direction; enhance directionally encoded audio components in the outputs which are directly involved in reproducing them in the intended direction so as to maintain constant total power for such signals; while preserving high separation between the left and right channel components of non-directional signals regardless of the steering signals; and maintaining the loudness defined as the total audio power level of non-directional signals effectively constant whether or not directionally encoded signals are present and regardless of their intended direction if present.

In a preferred embodiment, a surround sound decoder is provided for redistributing a pair of left and right audio input signals including directionally encoded and non-directional components into a plurality of output channels for reproduction through loudspeakers surrounding a listening area, and incorporating circuitry for determining the directional content of the left and right audio signals and generating therefrom at least a left-right steering signal and center-surround steering signal.

The decoder includes delay circuitry for delaying each of the left and right audio input signals to provide delayed left and right audio signals; a plurality of multipliers equal to twice the number of output channels, organized in pairs, a first element of each pair receiving the delayed left audio signal and a second element receiving the delayed right audio signal, each of the multipliers multiplying its input audio signal by a variable matrix coefficient to provide an output signal; the variable matrix coefficient being controlled by one or both of the steering signals. A plurality of summing devices are provided, one for each of the plurality of output channels, with each of the summers receiving the output signals of a pair of the multipliers and producing at its output one of the plurality of output signals. The decoder has the variable matrix values so constructed as to reduce directionally encoded audio components in outputs which are not directly involved in reproducing them in the intended direction; and so constructed to enhance directionally encoded audio components in the outputs which are directly involved in reproducing them in the intended direction so as to maintain constant total power for such signals; while preserving high separation between the left and right channel components of non-directional signals regardless of the steering signals; and so constructed to maintain the loudness defined as the total audio power level of non-directional signals effectively constant whether or not directionally encoded signals are present and regardless of their intended direction if present.

Although the invention is primarily described in terms of analog embodiments, an advantage of the invention is that it can be implemented as a digital signal processor.

An advantage of the present invention is that the design of the decoding matrix provides high left to right separation in all output channels.

A further advantage of the invention is that it maintains this high separation regardless of the direction of the dominant encoded signal.

Another advantage of the invention is that the total output energy level of any non-encoded decor related signal remains constant regardless of the direction of the dominant encoded signal.

Another advantage of the invention is that it can reproduce conventionally encoded soundtracks in a way which closely matches the sound of a 5+1 channel discrete soundtrack release.

Yet another advantage of the invention is that it provides a simple passive matrix encoding into two channels of a five channel soundtrack that will decode into five or more channels with very little subjective difference from the five channel original.

Another advantage of the invention is that it provides an active encoder which has better performance in respect to the left and right surround inputs than that achievable with a passive five-channel encoder.

While the decoder of the invention operates optimally with the active five channel encoder, another advantage of the invention is that with an added phase correction network it can also optimally reproduce movie soundtracks encoded with either the standard four channel passive encoder of the prior art or the five channel passive matrix encoder which is an aspect of the present invention.

BRIEF DESCRIPTION OF THE DRAWINGS

The novel features believed characteristic of the present invention are set forth in the appended claims. The invention itself, as well as other features and advantages thereof, will best be understood by reference to the following detailed description of an illustrative embodiment when read in conjunction with the accompanying drawing figures, wherein:

DETAILED DESCRIPTION OF THE INVENTION

Preferred embodiments of the invention include a five channel and a seven channel decoder with maximum lateral separation, although reference will be made to general design principles that may be applied to decoders with other numbers of channels as well.

In designing a passive matrix, the encoding will be assumed to follow the standard Dolby Surround matrix, and the decoder has four outputs such that the left output signal from the decoder comprises the left input times one; the center is the left input times 0.7 (strictly √0.5 or 0.7071) plus the right input times 0.7; the right output signal is the right input signal times one; and the rear output is the sum of the left input times 0.7 and the right input times –0.7.

Figure 1:
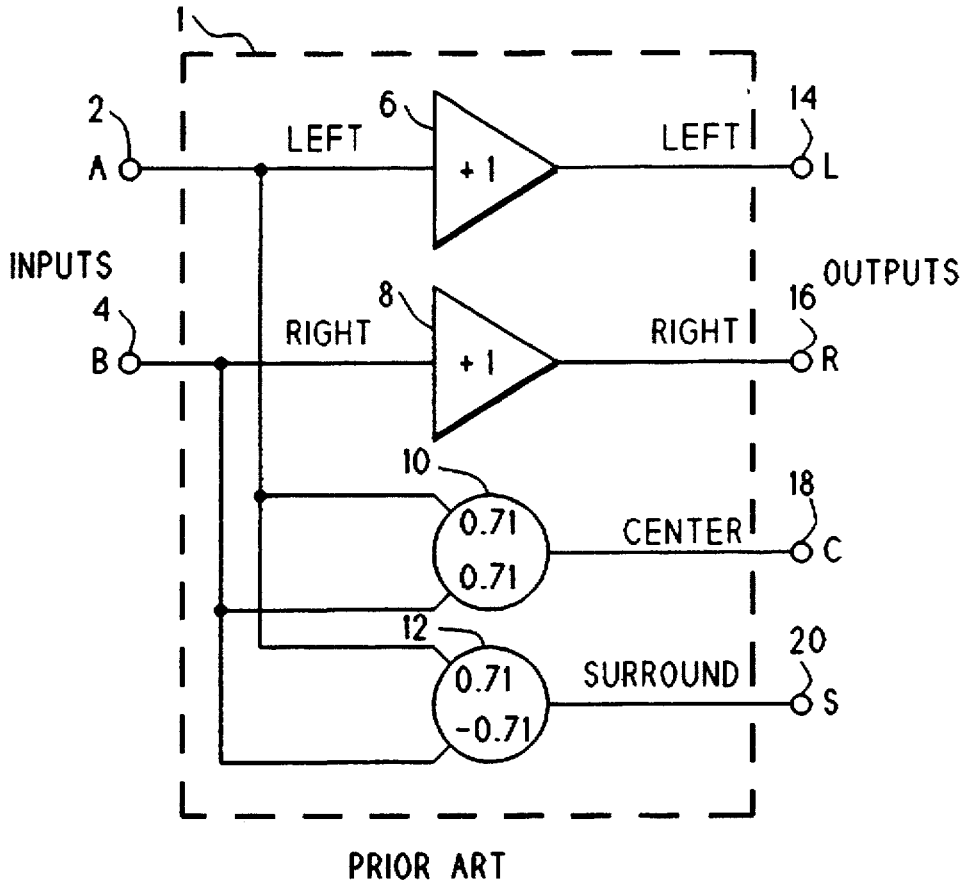
FIG. 1 is a block schematic of a passive matrix Dolby surround decoder according to the prior art.

Referring to FIG. 1, there is a simplified schematic of a passive Dolby surround matrix decoder 1 according to the prior art, in which these signal relationships are maintained. The LEFT and RIGHT audio signals are applied respectively to the input terminals 2, 4, and are buffered by unity gain buffer amplifiers 6 and 8 respectively. They are also combined in the above-specified ratios by signal combiners 10 and 12. The outputs of buffers 6, 8 appear at the LEFT and RIGHT output terminals 14, 16, respectively, and the outputs of signal combiners 10, 12, appear at the CENTER and SURROUND output terminals 18, 20.

As stated previously, this matrix has constant gain in all directions, and all outputs are equal in amplitude when inputs are decor related.

It is possible to extend the passive matrix design to more than four channels. If we wish to have a left rear speaker, the appropriate signal can be made by using suitable matrix elements, but additional conditions are required to form a unique solution; the loudness of the decor related component of the signal should be equal in all outputs, and the separation should be high in opposite directions.

The matrix elements are given by sines and cosines of the direction angle of the output. For example if the angle α is defined such that α=0 for a full left output and is 90° for an output at front center, then the front center matrix elements are:

$$\text{Left matrix element}=\cos(\alpha/2) \quad (1)$$

$$\text{Right matrix element}=\sin(\alpha/2) \quad (2)$$

Thus for α=90°, both matrix elements are 0.71, as specified by the standard Dolby Surround matrix.

The matrix elements as defined by equations (1) and (2) are valid for α=0 (full left) to α=180° (full right), where the sign of the matrix element for left changes. For the left rear quadrant, α goes from 0° to –90°, so that the sign of the right component is negative. For the right rear quadrant, however, the left matrix element sign is negative. At center rear, α=270° or –90°, and the two components are equal and opposite in sign; conventionally the right signal coefficient is negative in this case. This could be specified by stating the range of α in equations (1) and (2) as [–90°, 270°), where a square bracket implies inclusion of the adjacent limit value and a parenthesis implies that the limit is not included in the range.

The separation between two outputs is defined as the difference between the levels of a signal in one output and the signal in the other, expressed in decibels (dB). Thus if there is a full left signal, the right input component is zero, and the components in the left and center outputs are 1 and 0.71 respectively times the left input signal. The separation is a level ratio of 0.71 or –3 dB (the minus sign is normally dropped.)

The separation between any two directions which have an angle difference of 90° is always 3 dB for this matrix. For directions separated by less than 90°, the separation will be less than 3 dB. For example, outputs at full rear (α=–90°) and left rear (α=–45°) will have a separation given by:

$$\begin{aligned}\text{Separation} &= \cos(45°)*L/(\cos(22.5°)*L)=0.77 \quad (3)\\ &= 2.3dB\end{aligned}$$

This situation can be improved with an active matrix. The object of an active matrix is to increase separation between adjacent outputs when there is a directionally encoded signal at the decoder inputs. We can also raise the question of how such a decoder behaves when the inputs consist entirely of decor related "music", and how the decoder behaves when there is a mixture of a directional signal and music. In this context, we shall use the word "music" to denote any decor related signal of such complexity that both the directional control signals referred to previously and assumed to be derived from the stereophonic audio input signals are effectively zero.

The following design criteria may be applied to any active matrix, noting that they are fulfilled with various degrees of success by decoders in the current art.

A. When there is no decor related signal, there should be a minimum output from those channels not related to the ones involved in reproducing the directional signal. For example, a signal which is intended to be reproduced at a location halfway between right and center should produce no output in the left and rear channels. Likewise a signal intended for center should have no output in either left or right outputs. (This is the principle of pairwise mixing, as extended to surround sound reproduction.)

B. The output from the decoder for directional signals should have equal loudness regardless of the encoded direction. That is, the sum of the squares of the various outputs should be constant if a constant level directional component is moved through all directions. Most current art decoders do not achieve this criterion perfectly. There are loudness errors in all, but these errors are not significant in practice. This is the constant loudness criterion.

C. The loudness of a music (i.e. decor related) component of an input signal should be constant in all output channels regardless of how the directional component of the input is moved, and regardless of the relative levels of the directional component and the music. This requirement means that the sum of the squares of the matrix elements for each output should be constant as the matrix elements change with direction. Decoders in the current art disobey this criterion in ways which are often noticeable. This may be called the constant power criterion.

D. The transition between the reproduction of a decor related music component only, and the reproduction of a directional signal only, as their relative levels change, should occur smoothly and involve no shifts in the apparent direction of the sound. This criterion is also violated in various significant ways by decoders in the current art. It may be called the constant direction criterion.

In a film decoder which must obey the specification for Dolby Pro-Logic, a surround sound reproduction system in common use, criterion D above does not apply, and instead the following criterion E must be satisfied:

E. The signal intended to come from any direction in the front of the room, from left through center to right, should be boosted in level by 3 dB relative to the level such a signal would have in a passive Dolby Surround matrix when there is little or no decor related component of the input signals (i.e. no music is present.) When music is the dominant input signal (no correlated components present,) the level is not boosted. Thus as the decoder makes the transition from a music only signal to a pure directionally encoded signal, the level of the directional signal in the front hemisphere should be raised.

The optimal design of a decoder which matches the Dolby Pro-Logic specification should have decor related music constant in all channels except in outputs where there is a strong directionally encoded signal, and the music in these channels can rise in level a maximum of 3 dB proportional to the strength of the directional signal relative to the music. Music level should never decrease in any output where there is no directionally encoded signal. This may be called the minimal gain-riding criterion.

In all current active matrix decoders an implied principle of operation is that in the absence of a directionally encoded signal the matrix should revert to the passive matrix described above, as implemented for the desired number of output channels. This assumption appears at first glance reasonable; however, it is neither necessary nor desirable from the point of view of psychoacoustic perception. Decoders according to this invention replace the above assumption with a requirement:

F. An active decoder matrix should have maximum lateral separation at all times, both during reproduction of decor related music signals and for music signals in the presence of a directionally encoded signal. For example if the music signal has violins only on the left and cellos only on the right, these locations should be maintained regardless of the strength or direction of a concurrently present directional signal. This requirement can only be relaxed when a strong directionally encoded signal is being removed from an output which should not reproduce it. Under these conditions, the music will drop in level unless the matrix elements are altered to add more energy to the affected channel from the direction opposite to the steered direction. This will reduce separation, but this separation reduction is difficult to hear in the presence of a strong directionally encoded signal.

The need for high separation (especially when there is no directionally encoded signal) comes from psychoacoustics. Prior art has conceived of the matrix as inherently symmetric, with all directions being treated as equally important. However, this is not the case in practice. Humans have two ears, and in watching film or listening to music they generally face forward. Thus frontal and lateral sounds are perceived differently.

There is a dramatic difference between a sound field having up to 4 dB of separation and one which has more. (This fact was recognized in the CBS SQ matrix, which had lateral separation exceeding 8 dB in the passive decoder, while sacrificing front to rear separation.) In the inventor's opinion, the difference between a discrete five channel film reproduction and a conventional matrix reproduction is due to the low lateral separation between the surround channels.

Greisinger, U.S. Pat. No. 5,136,650, recognizes the value of this requirement (F) and describes a six channel decoder where the two additional channels are designed to be placed at the sides of the listener. These outputs have the desired properties for a left rear and a right rear output channel, as long as the directional component of the output is steered to the front hemisphere. That is, they reduce the level of the steered component, regardless of its direction, and they have full left-right separation when there is no directionally encoded signal. The outputs described in the above-referenced patent do not have constant level for non-directionally encoded music in the presence of a steered signal, and that defect is corrected in the present invention.

The encoder design in the above-referenced patent was used with some modification to make a number of commercially available decoders. The matrix design in the rear hemisphere for these decoders was developed heuristically, but generally meets the requirements stated above fairly well. There is, however, more "pumping" with music than would be optimal, and the leakage of steered signals between the left and right rear outputs is more than the desired level. In this context, "pumping" is audible variation of the music signal due to variation of the directional control signals responding to the direction of the directionally encoded signal.

For both reasons, it was necessary to improve the decoder design, and this invention resulted from this design effort. It turns out that the requirements A through F above uniquely specify a matrix, which will be mathematically described below.

For mathematical simplification, the encoder assumed in the design of the decoder is a simple left-right pan pot. When steering from left to center to right a standard sine-cosine curve is used, as described by equations (1) and (2) above. These may be restated in the form:

$$L=\cos t \tag{4}$$

$$R=\sin t \tag{5}$$

where $$t=\alpha/2 \tag{6}$$

In the frontal steering mode above, the angle t varies from 0° to 90°. For steering in the rear half of the room, from left to rear (surround) to right, the right channel pan pot output polarity is inverted. This can be described by the pair of equations $$L=\cos t \quad (7)$$

$$R=-\sin t \quad (8)$$

Full rear steering occurs when t=45°, and steering to left surround, a position intermediate between left and rear, occurs when t=22.5°.

Note the similarity of this encoding to the matrix elements of the passive matrix described above. Here, however, the steering angle is divided by two and the sign change for rear steering is included explicitly.

In designing the decoder, it must first be decided what outputs will be provided, and how the amplitude of the steered component of the input will vary in each output as the input encoding steering angle varies. In the mathematical description below, this function can be arbitrary. However, in order to satisfy requirement B, the constant loudness criterion, so that loudness is preserved as a signal pans between two outputs, there are some obvious choices for these amplitude functions.

Assuming that there will be front left, right and center outputs, the amplitude function for each of these outputs is assumed to be the sine or cosine of twice the angle t. For example, as t varies from left, t=0°, to center, t=45°, the output amplitudes should be:

$$\text{Left output}=\cos 2t \quad (9)$$

$$\text{Center output}=\sin 2t \quad (10)$$

$$\text{Right output}=0 \quad (11)$$

$$\text{As } t \text{ goes from center to right, } t=45° \text{ to } 90°\text{, Left output}=0 \quad (12)$$

$$\text{Center output}=\sin(2t-90°)=-\cos 2t \quad (13)$$

$$\text{Right output}=\cos(2t-90°)=\sin 2t \quad (14)$$

These functions result in optimum placement of sources between left and center, and between right and center. These functions also result in very simple solutions to the matrix problem. In either of the above cases, any output signals intended for reproduction in the rear of the room should be identically zero.

In designing the five channel version of the improved decoder, a signal steered in the rear hemisphere between left and left surround, t=0° to t=22.5°, should have:

$$\text{Left rear output}=\sin 4t \quad (15)$$

$$\text{Right rear output}=0 \quad (16)$$

and when steered between left surround and full rear the total rear output should stay the same. The matrix coefficients used to achieve this are not constant, but vary such that at full rear steering the matrix element for the right input into the left rear output goes to zero.

In the seven channel embodiment, as t goes from 0° to 22.5°, the output in both the left side and left rear outputs should be equal and smoothly rising, proportional to sin 4t. As t goes from 22.5° to 45°, the output in the left side goes down 6 dB and the output in the left rear goes up 2 dB, keeping the total loudness, the sum of the squares of each output, constant.

As mentioned above, in the improved decoder even when the steered signal is fully to the rear, the left rear and right rear outputs have maximum separation for decor related music, since the matrix elements for the right input to the left rear output (and for the left input into the right rear output) are zero resulting in complete separation. Although the right rear has zero output to a steered signal as the steering angle t goes from 0° to 22.5°, the matrix elements used to achieve this signal cancellation are adjusted so that the music output is constant and has minimum correlation with the music signal in the left rear.

To additionally decrease the correlation in the surround field, the seven channel embodiment includes a time delay of about 15 ms in the side channels, and in both versions the rear channels are delayed by about 25 ms.

Once the loudness functions are chosen for the various outputs under steered conditions, these functions having left to right symmetry, the functional dependence of the matrix elements on the steering angle can be computed.

A standard Dolby surround installation has all the surround loudspeakers wired in phase, and Dolby screening theaters are similarly equipped. However, the standard passive matrix, described above with reference to FIG. 1, has a problem with the left rear and right rear outputs. A pan from left to surround results in a transition between L and L-R, and a pan from right to surround goes from R to R-L. Thus the two rear outputs are out of phase when they are fully steered rear. The Fosgate 6-axis decoder described in U.S. Pat. No. 5,307,415, among others, has this phase anomaly. In listening to such decoders, this phase inversion was felt to be unacceptable, as a rear-steered sound, such as a plane fly-by, became both thin and phasey in the rear. The decoder of the present invention includes a phase shifter to flip the sign of the right rear output under full rear steering. The phase shift is made a function of the log ratio of center over surround, and is inactive when there is forward steering. Typical phase shifters for this purpose are described below with reference to FIGS. 5*a* and 5*b*.

Real world encoders are not as simple as the pan pot mentioned above. However, by careful choice of the method of detecting the steering angle of the inputs, the problems with a standard four-channel encoder can be largely avoided.

Thus even a standard film made with a four channel encoder will decode with a substantial amount of directional steering in the rear hemisphere.

Figure 2:
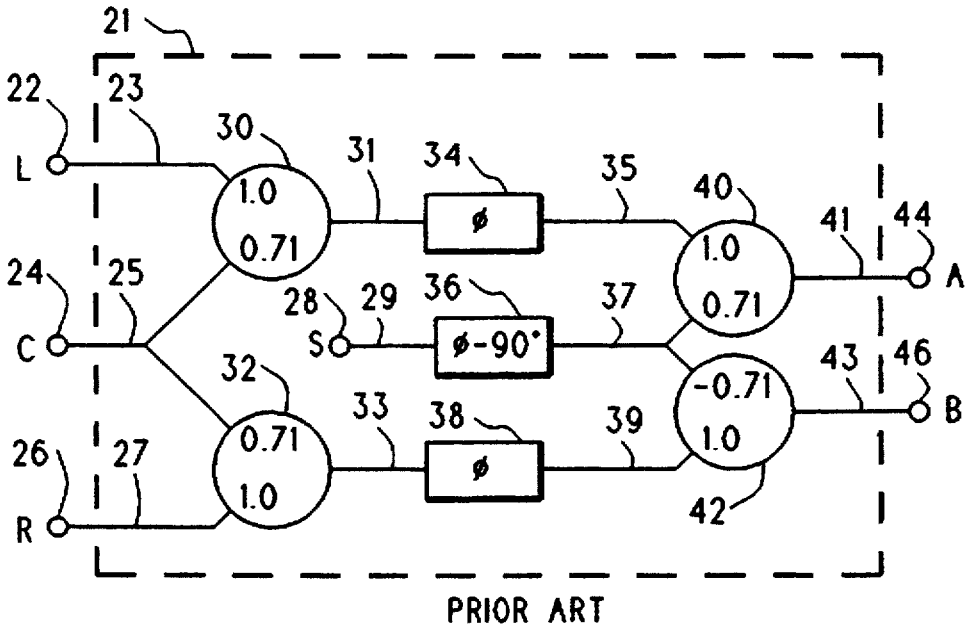
FIG. 2 is a block schematic of a standard Dolby matrix encoder according to the prior art.

Referring to FIG. 2, which represents a standard encoder 21 according to the prior art, as shown in FIG. 1 of the prior Greisinger U.S. Pat. No. 5,136,650. There are four input signals L, R, C and S (for left, right, center and surround, respectively,) which are applied to corresponding terminals 22, 24, 26 and 28 and signal combiners and phase shifting elements as shown. The left (L) signal 23 from terminal 22 and center (C) signal 25 from terminal 24 are applied to a signal combiner 30 in ratios 1 and 0.707 respectively; the right (R) signal 27 from terminal 26 and the center (C) signal 25 are similarly applied with the same ratios to signal combiner 32. The output 31 of signal combiner 30 is applied to a phase shifter 34, and the output 33 of signal combiner 32 is applied to a second identical phase shifter 38. The surround (S) signal 29 from terminal 28 is applied to a third phase shifter 36, which has a 90° phase lag relative to the phase shifters 34, 38. The output 35 of phase shifter 34 is applied to signal combiner 40, along with 0.707 times the output 37 of phase shifter 36. Similarly, the output 39 of phase shifter 38 is combined with −0.707 times the output 37 of phase shifter 36 in the signal combiner 42. The outputs A and B of the encoder are the output signals 41 and 43 of the signal combiners 40 and 42 respectively.

Mathematically, these encoder outputs can be described by the equations:

$$\text{Left output } (A)=L+0.707C+0.707jS \quad (17)$$

$$\text{Right output } (B)=R+0.707C-0.707jS \quad (18)$$

Although a standard four channel encoder will not work with five channel discrete film, it is possible to design a five channel encoder which will work very well with the improved decoder according to the present invention. Such an encoder is described with reference to FIG. 3.

The additional elements of the new encoder 48 are applied ahead of the standard encoder 21 of FIG. 2, described above.

Figure 3:
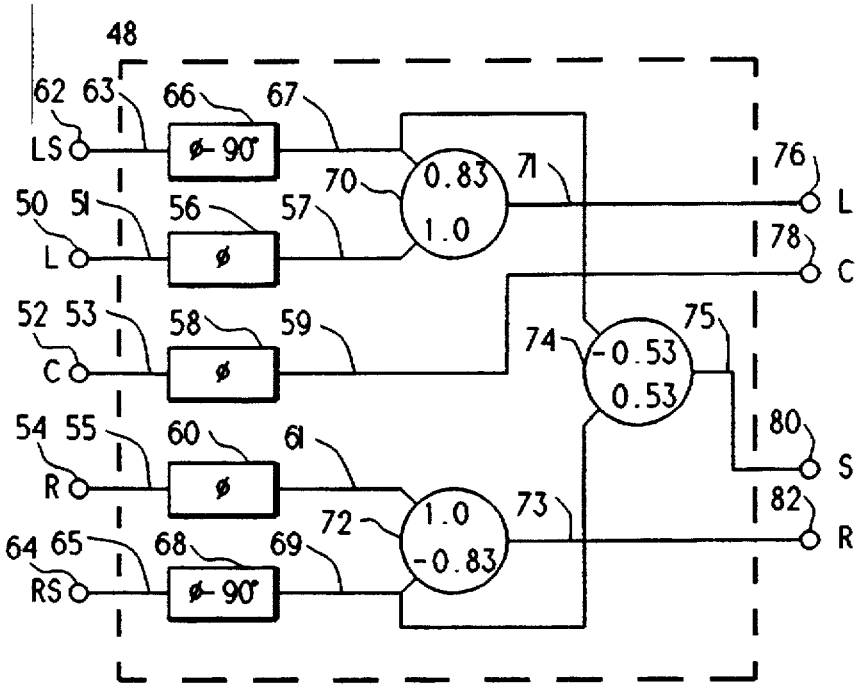
FIG. 3 is a block schematic of a five channel encoder for producing Dolby matrix compatible encoding of discrete five channel soundtracks according to the present invention.

The left, center and right signals 51, 53 and 55 are applied to terminals 50, 52 and 54, respectively, of FIG. 3. In each of the left, center, and right channels, an all-pass phase shifter, 56, 58 and 60 respectively, having a phase shift function $\phi(f)$ (shown as $\phi$) is inserted in the signal path. The left surround signal 63 is applied to input terminal 62 and then through an all-pass phase shifter 66 with phase shift function $\phi$-90°. The right surround signal 65 from input terminal 64 is applied to a $\phi$-90° phase shifter 68.

The signal combiner 70 combines the left phase-shifter output signal 57 from phase shifter 56 with 0.83 times the left surround phase-shifted output signal 67 from phase shifter 66 to produce the output signal 71 labeled L, which is applied via terminal 76 to the left input terminal 22 of standard encoder 21.

Similarly, the signal combiner 72 combines the right phase-shifter output signal 61 from phase shifter 60 with −0.83 times the right surround phase-shifted output signal 69 from phase shifter 68 to produce the output signal 73 labeled R, which is applied via terminal 82 to the right input terminal 26 of standard encoder 21.

Similarly, the signal combiner 74 combines −0.53 times the left surround phase-shifter output signal 67 from phase shifter 66 with 0.53 times the right surround phase-shifted output signal 69 from phase shifter 68 to produce the output signal 75 labeled S, which is applied via terminal 80 to the surround input terminal 28 of standard encoder 21.

The output signal 59 of the center phase shifter 58, labeled C, is applied via terminal 78 to the center input terminal 24 of standard encoder 21.

The encoder of FIG. 3 has the property that a signal on any of the discrete inputs LS, L, C, R and RS will produce an encoded signal which will be reproduced correctly by the decoder of the present invention. A signal which is in phase in the two surround inputs LS, RS, will produce a fully rear steered input, and a signal which is out of phase in the two surround inputs will produce an unsteered signal, since the outputs A and B of the standard encoder will be in quadrature.

The mathematical description of the encoder of FIG. 3 used in conjunction with the standard encoder of FIG. 2 may be given in the form:

$$A=(L+j0.83LS)+0.71C+0.38(LS-RS) \quad (19)$$

$$B=(R-j0.83RS)+0.71C-0.38(LS-RS) \quad (20)$$

All current surround decoders which use active matrices control the matrix coefficients based on information supplied from the input signals. All current decoders, including that of the present invention, derive this information by finding the logarithms of the rectified and smoothed left and right input signals A and B, their sum A+B and their difference A−B. These four logarithms are then subtracted to get the log of the ratio of the left and right signals, l/r, and the log of the ratio of the sum and difference signals, which will be identified as c/s, for center over surround. In this description, l/r and c/s are assumed to be expressed in decibels, such that l/r is positive if the left channel is louder than the right, and c/s is positive if the signal is steered forward, i.e. the sum signal is larger than the difference signal. The attenuation values in the five channel passive encoder above are chosen to produce the same value of l/r when the LS input only is driven, it being understood that the simplified encoder is used to design the decoder when the angle t has been set to 22.5° (rear). In this case, l/r is 2.41, or approximately 8 db.

For a monaural signal which has been distributed with the simplified encoder between the two input channels such that A=cos t and B=±sin t, l/r and c/s are not independent. To find the steering angle t, we need only find the arctangent of the left level divided by the right level, or if we define full left as t=0, then:

$$t=90°-\arctan\,(10\hat{}((l/r)/20)) \quad (21)$$

degrees if l/r is in dB as stated above.

However, since the two levels are compared in magnitude only, to determine whether the steering is front or back we need to know the sign of c/s, which is positive for forward steering and negative for rear steering.

In the real world, the input signals to the decoder are not derived from a pan pot but from an encoder as shown in FIG. 2, which utilizes quadrature phase shifters. In addition, there is almost always decor related "music" present along with steered signals.

In the following description, the problem of specifying the matrix elements is divided into four sections, depending on what quadrant of the encoded space is being used, i.e. left front, left rear, right front or right rear.

We will assume a seven channel decoder with outputs at left front, center, right front, left side, right side, left rear and right rear outputs. Two matrix elements must be specified for each output, and these will be different depending on the quadrant for the steering. The right front and right rear quadrant coefficients can be found by reflection about the front-back axis, as the matrix has left-right symmetry, so only the left front and left rear steering effects will be derived here.

For the front quadrant, we will assume that requirement D above, rather than requirement E for Dolby surround, is used, and add the correction later.

Front steering is similar to Greisinger (U.S. Pat. No. 5,136,650) but the functions which describe the steering in the present invention are different, and unique. To find them we must consider each output separately.

The left output should decrease to zero as the angle t varies from 0° to 45°, since we do not want any center steered signals to appear in the left front channel. If t=0 is full left, we define an angle $$ts=\arctan\,(10\hat{}((c/s)/20))-45° \quad (22)$$

The left output is the matrix element LL times the left input plus the matrix element LR times the right input. A fully steered signal from the simplified encoder results in the left input A=cos ts and the right input B=sin ts over this range. We want the level in the left output to smoothly decrease as t increases, following the function FL(ts), which in our example decoder is assumed to be equal to cos(2ts). Thus the left output is described by:

$$\begin{aligned}\text{Left output} &= LL\cos ts + LR\sin ts \\ &= FL(ts)=\cos(2ts)\end{aligned} \quad (23)$$

If the output to decor related music is to be constant, the sum of the squares of the matrix coefficients must be one, i.e.

$$LL^2+LR^2=1 \quad (24)$$

These equations, which are basically in the same form for all outputs, result in a quadratic equation for LFR, which has two solutions. In every case, one of these solutions is greatly preferred over the other. For the left output, $$LR=\sin ts \cos (2ts)\pm\cos ts \sin (2ts) \quad (25)$$

$$LL=\cos ts \cos (2ts)\pm\sin ts \sin (2ts) \quad (26)$$

Choosing the preferred sign, which is minus in equation (25) and plus in equation (26), and applying mathematical identities, these simplify further to:

$$LL=\cos ts \quad (27)$$

$$LR=-\sin ts \quad (28)$$

The right output should be zero over the same range of the angle ts, i.e.

$$\text{Right output}=RL \cos ts+RR \sin ts=0 \quad (29)$$

Once again, the decor related music should be constant, so $$RL^2+RR^2=1 \quad (30)$$

and these lead by similar reasoning to the result $$RL=-\sin ts \quad (31)$$

$$RR=\cos ts \quad (32)$$

The center output should smoothly decrease as steering moves either left or right, and this decrease should be controlled by the magnitude of l/r, not the magnitude of c/s. Strong steering in the left or right directions should cause the decrease. This will result in quite different values for the center left matrix element CL and the center right element CR, which will swap when the steering switches from right to left. The l/r based steering angle will be called tl here. It is assumed to go from 0° at full left to 45° when steering is full center or when there is no steered signal.

$$tl=90°-\arctan (10^{\wedge}((l/r)/20)) \quad (33)$$

where l/r is expressed in dB.

The center output should smoothly increase as tl varies from 0° (full left) to 45° (center). The function for this increase will be called FC(tl), which is equal to sin(2tl) in this embodiment. By the above method, $$\begin{aligned}\text{Center output} &= CL \cos tl + CR \sin tl = FC(tl) \\ &= \sin(2tl)\end{aligned} \quad (34)$$

Once again, for constant loudness of the music, $$CL^2+CR^2=1 \quad (35)$$

which yields the solutions $$CR=\sin tl \sin (2tl)\pm\cos tl \cos (2tl) \quad (36)$$

$$CL=\cos tl \sin (2tl)\pm\sin tl \cos (2tl) \quad (37)$$

The preferred sign is plus in equation (36) and minus in equation (37).

The matrix elements for the rear outputs during front steering are not as simple to derive as those for the front outputs. To derive them, we use the argument and formulae presented in Greisinger (U.S. Pat. No. 5,136,650.)

The problem is that we want the left rear LRL matrix element to be 1 when there is no steering, and yet we want no directional output from this channel during either left or center steering. If we follow the method used above, we get matrix elements which give no output when the signal is steered to the left or center, but when there is no steering, the output will be the sum of the two input signals. This is a conventional solution, where there is poor separation when steering stops. We want full separation, which means LRL must be one and LRR must be zero with no steering.

To solve this problem, the matrix must be made dependent both on the value of l/r and that of c/s. A solution is given in Greisinger (U.S. Pat. No. 5,136,650) in which side left and right outputs are the "supplemental outputs". The solution derived there solves the problem of canceling the directional component at all angles in the left side output, but the music component of the output decreases by 3 dB as the steering goes to full center.

We can correct the coefficients to avoid this defect by multiplying them by the factor (cos ts+sin ts), where ts is an angle which is zero when c/s is one, and which increases to 45° when c/s is large and positive. In the following equations, the angles ts and tl are derived from c/s and l/r respectively:

$$ts=\arctan (c/s)-45° \quad (38)$$

$$tl=\arctan (l/r)-45° \quad (39)$$

Note that tl here is different from the angle defined previously for the center output.

In the terminology of the previous patent, the control signals developed at the inputs to several variable gain amplifiers (VGAs) are called GL, GC, GR and GS for left, center, right and surround respectively, and two supplemental signals GSL and GSR are derived from these for the left and right surround VGA's. The coefficients here described use a linear combination of the G values to provide the left and right coefficients as a function of the two angles ts, derived from c/s, and tl, derived from l/r, respectively.

By the definitions therein, $$GL=((\cos tl-\sin tl)/\cos tl)=1-\tan tl \quad (40)$$

$$GC=2(\sin ts/(\cos ts+\sin ts)) \quad (41)$$

(there is a factor of two that was omitted in the printing of the earlier patent), $$GS=0 \quad (42)$$

(since this is a front quadrant), and $$\begin{aligned}GSL &= GL((1-\sin tl)/\cos tl) \\ &= GL(\sec tl-\tan tl) \\ &= (1-\tan tl)(\sec tl-\tan tl)\end{aligned} \quad (43)$$

and the left and right supplemental signals are given by:

$$LS=A(1-GSL)-0.5(A+B)GC-0.5(A-B)GS-B\times GL \quad (44)$$

$$RS=B(1-GSR)-0.5(A+B)GC+0.5(A-B)GS-A\times GR \quad (45)$$

Thus, the coefficients LSL and LRL are given by:

$$\begin{aligned}LSL &= LRL=(\cos ts+\sin ts)(1-GSL-0.5GC) \\ &= (\cos ts+\sin ts) \\ &\quad x\left[1-\frac{(1-\sin tl)}{\cos tl}\times\frac{(\cos tl-\sin tl)}{\cos tl}-0.5\times\frac{2\sin ts}{(\cos ts+\sin ts)}\right]\end{aligned} \quad (46)$$

which becomes, after some manipulation, $$LSL=LRL=(\cos ts+\sin ts)(\sec tl-1)\times(\sec tl-\tan tl)-\sin ts \quad (47)$$

The coefficients LSR and LRR are also equal, given by:

$$LSR = LRR = (\cos ts + \sin ts)(-0.5\,GC - GL) \quad (48)$$
$$= (\cos ts + \sin ts)$$
$$x\left[-\frac{(\cos tl - \sin tl)}{\cos tl} - 0.5 \times \frac{2 \sin ts}{(\cos ts + \sin ts)}\right]$$

which becomes, after some manipulation, $$LSR=LRR=(\cos ts+\sin ts)(\tan ti-1)-\sin ts \quad (49)$$

The right side and rear outputs when the input is steered between left and center can be found with the previous method, but the steering angle used must be ts, derived from c/s, so that it will revert to the right input when there is no steering. We need only remove signals which are steered to center. The equations to solve are:

$$\text{Right rear output}=RRL \cos ts-RRR \sin ts=0 \quad (50)$$

and $$RRL^2+RRR^2=1 \quad (51)$$

which yield the solution:

$$RRR=RSR=\cos ts$$
$$RRL=RSL=\sin ts \quad (52)$$

The above equations completely specify the matrix elements for front steering. For rear steering, when c/s is negative the following are true:

The left and right main elements are the same as for front steering, except that the angle ts is determined from the absolute value of log(c/s) which yields:

$$ts=\arctan(10^{\wedge}(s/c)/20))-45° \quad (53)$$

and the sign of the cross matrix element is reversed, yielding:

$$LL=\cos ts \quad (54)$$
$$LR=\sin ts \quad (55)$$

and $$RL=\sin ts \quad (56)$$
$$RR=\cos ts \quad (57)$$

The center matrix elements are identical in rear steering as they depend only on angles derived from l/r, and are not dependent on the sign of c/s.

The side left and side right outputs should have full separation when steering is low or zero. However, the signal on the left side and rear outputs must be removed when there is strong left steering.

We use the previous definition for tl for center steering, $$tl=90°-\arctan(10^{\wedge}((l/r)/20)) \quad (58)$$

as tl varies from 0° to 22.5°. Under strong steering, the left side and left rear outputs are zero when tl=0°, but increase with tl according to the value sin 4tl. In the presence of uncorrelated music, represented by the signals A=cos t, B=−sin t, the coefficients LSL, LRL, LSR and RSR must satisfy:

$$LSL=LRL \quad (59)$$
$$LSR=LRR \quad (60)$$

to have equal outputs at the sides and rear, and the amplitude during steering follows FS(tl)=sin 4tl, so that $$LSL \cos tl-LSR \sin tl=FS(tl) \quad (61)$$

For the music to have constant level, $$LSL^2+LSR^2=1 \quad (62)$$

Solving as before, $$-LSR=\sin tl\, FS(tl)\pm\cos tl\sqrt{(1-FS(tl)^2)} \quad (63)$$
$$LSL=\cos tl\, FS(tl)\pm\sin tl\sqrt{(1-FS(tl)^2)} \quad (64)$$

Simplifying and using the preferred sign, as before, $$-LSR=\sin tl \sin 4tl+\cos tl \cos 4tl \quad (65)$$
$$LSL=\cos tl\, sin\, 4tl-\sin tl \cos 4tl \quad (66)$$

which may be further reduced to:

$$-LSR=\cos 3tl \quad (67)$$
$$LSL=\sin 3tl \quad (68)$$

The right side and right rear outputs are inherently free of the left input when there is steering in the left rear quadrant, but we must remove signals steered center or rear, so terms must be included that are sensitive to c/s. Right side and right rear outputs are equal, except for different delays, and we have to solve:

$$\text{Right rear/side output}=RSL \cos ts+RSR \sin ts=0 \quad (69)$$
$$RSL^2+RSR^2=1 \quad (70)$$

which yield the solution:

$$RSL=\sin ts \quad (71)$$
$$RSR=\cos ts \quad (72)$$

So far, the decoder design meets all of the requirements set out at the start. Signals are removed from outputs where they do not belong, full separation is maintained when there is no steering, and the music has constant level in all outputs regardless of steering. Unfortunately, we cannot meet all of these requirements for the rear output in the rear quadrant. One of the assumptions must be broken, and the least problematic one to break is the assumption of constant music level as the steering goes to full rear. The standard film decoder does not boost the level to the rear speaker, and thus a standard film decoder does not increase the music level as a sound effect moves to the rear. The standard film decoder has no separation in the rear channels. We can get the rear separation we want only by allowing the music level to increase by 3 dB during strong rear steering. This is in practice more than acceptable. Some increase in music level under these conditions is not audible—it may even be desirable.

We have been finding the matrix elements to the rear based on a steering angle tl derived from the l/r level ratio. As we move from tl=22.5° to tl=45°, this ratio expressed in dB decreases to zero, while the log of the center to surround ratio (c/s) becomes a large negative value.

Consider what happens when a directional signal at tl=22.5° is faded down into non-directional music. In this case, again, the log of l/r decreases to zero as the non-directional music becomes predominant. We need to distinguish this case from that above, where the steering goes strongly to the rear. The best solution is to make the matrix elements relax to high separation when l/r goes to zero, while keeping the music level constant. The result is easy to derive:

$$tl=90°-\arctan(l/r) \quad (73)$$

$$LRL=\cos(45°-tl) \quad (74)$$

$$LRR=-\sin(45°-tl) \quad (75)$$

where tl goes from 22.5° to 45°. These matrix elements keep the music level constant, but they cause the output of a steered signal to decrease by 3 dB when the signal goes to the rear. We can fix this by adding a dependency on c/s, by boosting the LRL value by an amount proportional to the increase in the log of the c/s ratio. Solving for the value of boost needed to keep the rear output level constant, we can express the results in a table:

TABLE 1

Variation of RBOOST with c/s

| c/s in dB | RBOOST |
|---|---|
| −32 | 0.41 |
| −23 | 0.29 |
| −18 | 0.19 |
| −15 | 0.12 |
| −13 | 0.06 |
| −11 | 0.03 |
| −9 | 0.01 |
| −8 | 0.00 |

In terms of these results, the left rear output matrix coefficients in the five channel version are:

$$LSL=\cos(45°-tl)+RBOOST(\log c/s) \quad (76)$$

$$LSR=-\sin(45°-tl) \quad (77)$$

and similarly for the right channel, $$RSL=\sin(45°-tl) \quad (78)$$

$$RSR=\cos(45°-tl)+RBOOST(\log c/s) \quad (79)$$

For the seven channel embodiment of the invention, we add an additional dependency on c/s to take into account the desired reduction of output in the left side and right side channels as the steering goes to full rear, remembering that left side and left rear coefficients were equal in the case of steering from full left to left rear. The reduction of side output is accompanied by a boost in the corresponding rear output to maintain constant power in the steered signal. It may also be desirable to increase the cross term, which reduces the separation a little, but apparently this is not audible.

We define a rear side boost function RSBOOST(ts) using an angle ts derived from the value of c/s:

$$ts=90°-\arctan(s/c) \quad (80)$$

where ts varies from 22.5° to 45°, so that the RSBOOST function rises from zero at ts=22.5° to 0.5 at ts=45°. Then $$RSBOOST=0.5\sin(2(ts-22.5°)) \quad (80)$$

and for the side outputs, $$LSL=\cos(45°-tl)+RBOOST(\log c/s)-RSBOOST(ts) \quad (81)$$

$$LSR=-\sin(45°-tl) \quad (82)$$

$$RSL=\sin(45°-tl) \quad (83)$$

$$RSR=\cos(45°-tl)+RBOOST(\log c/s)-RSBOOST(ts) \quad (84)$$

and for the rear outputs, $$LRL=\cos(45°-tl)+RBOOST(\log c/s)+0.5\ RSBOOST(ts) \quad (85)$$

$$LRR=-\sin(45°-tl) \quad (86)$$

$$RRL=\sin(45°-tl) \quad (87)$$

$$RRR=\cos(45°-tl)+RBOOST(\log c/s)+0.5\ RSBOOST(ts) \quad (88)$$

For the film decoder mode, we have to replace criterion D above by criterion E, which entails boosting the levels in front channels by 3 dB in all front directions. The matrix can be made to perform this way by adding similarly derived boost terms to the front elements during front steering. For example, during left steering the LL matrix element, here called LFL, should be increased by a boost function depending on l/r, where we define two angles:

$$tlr=90°-\arctan(l/r) \quad (89)$$

$$trl=90°-\arctan(r/l) \quad (90)$$

Then (cf. eq. (27) above), $$LFL=\cos ts+LFBOOST(tlr) \quad (91)$$

and for steering to the right, $$RFR=\cos ts+LFBOOST(trl) \quad (92)$$

Both center matrix elements are also boosted during center steeling:

$$CL=\sin tl+0.71\ LFBOOST(ts) \quad (93)$$

$$CR=\cos tl+0.71\ LFBOOST(ts) \quad (94)$$

These equations completely specify the additional requirements for a film decoder.

When there is no center channel loudspeaker, the Dolby specification suggests that the center channel output should be added to the left front and right front outputs with a gain of −3 dB or 0.707. While this reproduces the center channel dialog at the proper level, it reduces the separation between left and right. For example, when there is no steering, the center output is 0.71L+0.71R. Adding this to left and right yields a left output of 1.5L+0.5R and a right output of 1.5R+0.5L, so that the separation is reduced to 0.5/1.5=9.5 dB.

To avoid this effect, it would be better to modify the left and right matrix elements when there is center steering, using the angle ts derived from c/s, so that:

$$LFL=1+LFBOOST(ts) \quad (95)$$

$$RFR=1+LFBOOST(ts) \quad (96)$$

$$LFR=RFL=0 \quad (97)$$

Unlike the previously derived matrix coefficients, these do not remove the dialog from the left and right channels, and also keep it at the proper loudness in the room, while maintaining full left-right separation for music as long as the steering is in the front hemisphere.

Figure 4:
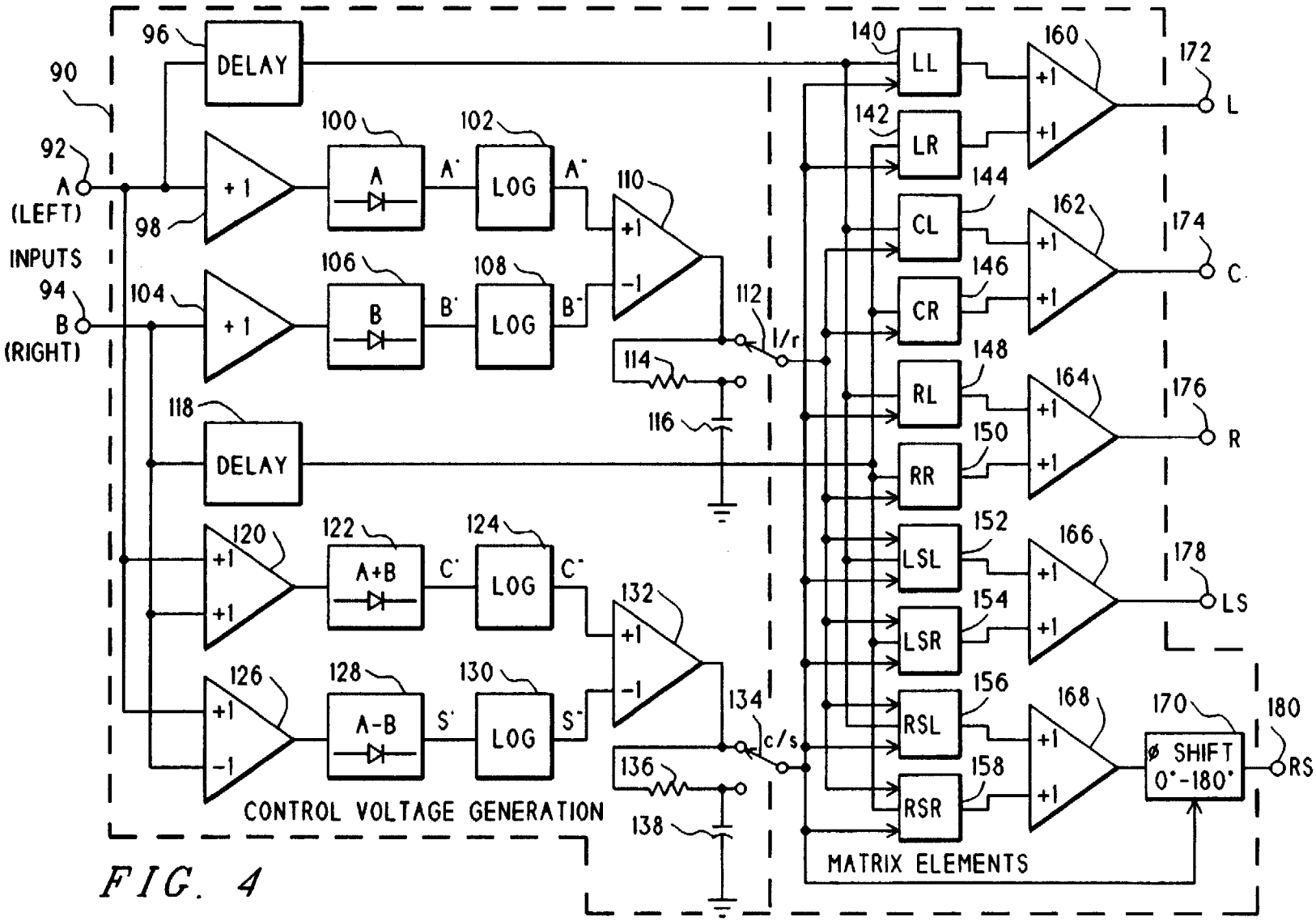
FIG. 4 is a block schematic of a five channel embodiment of the decoder according to the invention.

In a preferred five channel embodiment shown in FIG. 4, five of the seven channels described above are implemented, and the decoder provides the left, center, right, left rear and right rear outputs, the left side and right side outputs being omitted. It is understood from the above mathematical description that the circuitry for the left rear and right rear outputs of the seven channel decoder can be obtained by similar circuitry to that for the left and right surround outputs shown, with an additional 10 ms delay similar to the blocks 96 and 118 which implement 15 ms delays.

The addition of the RBOOST, RSBOOST and LFBOOST functions as described for the seven channel decoder, the film decoder mode and the missing center channel mode in the last section will be simple modifications apparent to those skilled in the art. In the digital implementation, they consist merely of adding the appropriate boost expressions derived from the angles ts and tl with appropriate definitions based on the steered direction to the corresponding matrix coefficients before performing the multiplications and additions required to generate the matrixed output signals.

Figure 7:
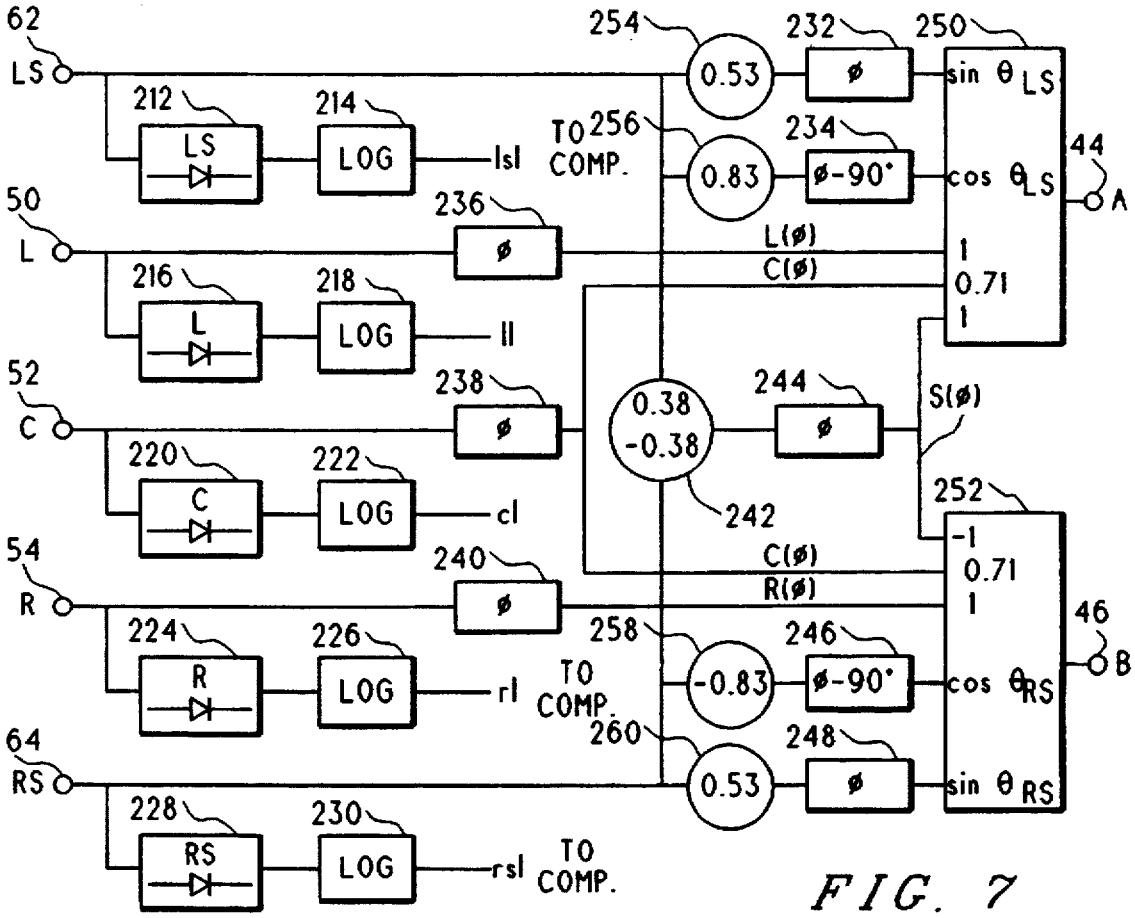
FIG. 7 shows a block schematic of an active encoder according to the invention.

In the decoder 90 of FIG. 4, the input terminals 92 and 94 respectively receive the left and right stereophonic audio input signals labeled A and B, which may typically be outputs from the encoders of FIGS. 2, 3, or 7, directly or after transmission/recording and reception/playback through typical audio reproduction media.

The A signal at terminal 92 passes through a short (typically 15 ms) delay before application to other circuit elements to be described below, so as to permit the signal processing which results in the l/r and c/s signals to be completed in a similar time period, thereby causing the control signals to act on the delayed audio signals at precisely the right time for steering them to the appropriate loudspeakers.

The A signal from terminal 92 is buffered by a unity gain buffer 98 and passed to a rectifier circuit 100 and a logarithmic amplifier 102.

Similarly, the B signal from terminal 94 is passed through a buffer 104, a rectifier 106 and a logarithmic amplifier 108.

The outputs of the logarithmic amplifiers 102 and 108, labeled A" and B" respectively, are combined by subtractor 110 to produce the l/r directional control signal, which is passed through switch 112 to the matrix circuitry described below. In the alternate position of switch 112, a time constant comprising resistor 114 and capacitor 116 is interposed in this path to slow down the output transitions of the l/r signal.

The B signal from terminal 94 is also passed through a 15 ms delay for the reason stated above.

The A and B signals from terminals 92 and 94 are combined in an analog adder 120, rectified by rectifier 122 and passed through logarithmic amplifier 124.

Similarly, the A and B signals are subtracted in subtractor 126, then passed through rectifier 128 and logarithmic amplifier 130. The signals from the logarithmic amplifiers 124 and 130 are combined in subtractor 132 to produce the signal c/s, which is passed through switch 134. In the alternative position of switch 134, the signal passes through the time constant formed by resistor 136 and capacitor 138, which have identical values to the corresponding components 114 and 116. Thus far, the control voltage generation circuit has been described. As is typical of such circuits, the l/r and c/s signals vary in proportion to the logarithms of the ratios between the amplitudes of left A and right B, and of center (sum) and surround (difference) of these signals.

The matrix elements are represented by the circuit blocks 140–158, which are each labeled according to the coefficient they model, according to the preceding equations. Thus, for example, the block 140 labeled LL performs the function described by equation (27), (54), (91) or (95) as appropriate. In each case, this function depends on the c/s output, which is shown as an input to this block with an arrow, to designate it as a controlling input rather than an audio signal input. The audio input is the delayed version of left input signal A after passing through the delay block 96, and it is multiplied by the coefficient LL in block 140 to produce the output signal from this block.

The outputs of the several matrix elements are summed in summers 160–168 thus providing the five outputs L, C, R, LS and RS at terminals 172, 174, 176, 178, and 180 respectively. As mentioned above, the RS signal is passed through a variable phase shifter 170 before being applied to the output terminal 180. Phase shifter 170 is controlled by the c/s signal to provide a phase shift which changes from 0° to 180° as the signal c/s steers from front to rear.

In the seven channel version of the decoder, circuit elements 152–158, 166, 168 and 170 are duplicated, being fed from the same points as their corresponding elements shown in FIG. 4, but with the coefficients LRL, LRR, RRL and RRR in blocks corresponding to 152–158 respectively, and with additional 10 ms delays similar to blocks 96 and 118, which may be inserted either ahead of these blocks or after the corresponding summer elements to blocks 166 and 168.

Although an analog implementation is shown in FIG. 4, it is equally possible, and may be physically much simpler, to implement the decoder functions entirely in the digital domain, using a digital signal processor (DSP) chip. Such chips will be familiar to those skilled in the art, and the block schematic of FIG. 4 will be readily implemented as a program operating in such a DSP to perform the various signal delays, multiplications and additions, as well as to derive the signals l/r and c/s and the angles tl and ts from these signals, to be used in the equations previously disclosed, so as to provide the full functionality of the decoder according to the present invention.

Figure 5A:
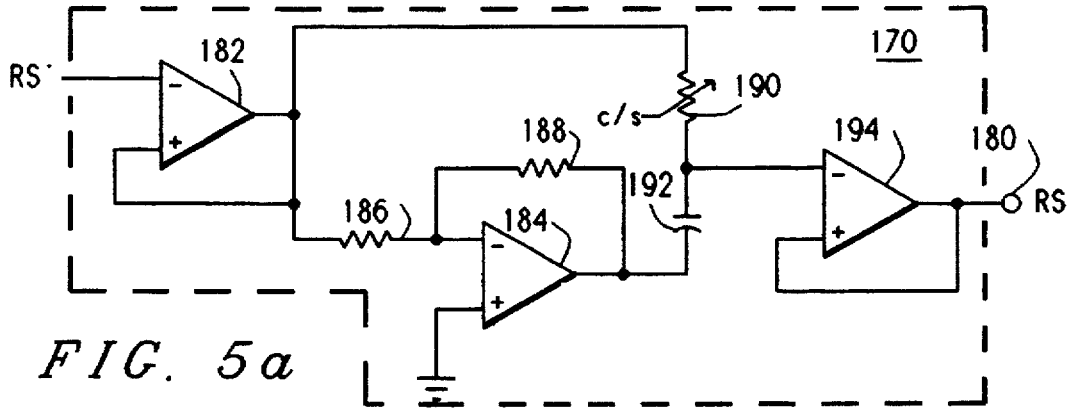
FIGS. 5*a* and 5*b* show detailed schematics for a typical phase shifter that may be used in the circuit of FIG. 4.

Turning to FIG. 5*a*, an analog version of the phase shifter 170 is shown. In this phase shifter circuit, the input signal RS' is buffered by an operational amplifier 182 and then inverted by a second operational amplifier 184 with the input resistor 186 and equal feedback resistor 188 defining unity gain. The outputs of amplifiers 182 and 184 are respectively applied through variable resistor 190 and capacitor 192 to a third operational amplifier 196, which buffers the voltage at the junction of the variable resistor 190 and capacitor 192 to provide the output signal RS to terminal 180 of FIG. 4. This circuit is a conventional single pole phase shifter having an all-pass characteristic.

The variable resistor 190 is controlled by the c/s signal in such manner that the turnover frequency of the phase shifter is high when the signal is steered to the front, so that the rear output signals are out of phase (due to the matrix coefficients) but reduces as the signal steers to the rear, so that the rear output signals become in phase due to inversion of the right rear output RS. Although the phase shift is not the same at all frequencies, the psychoacoustic effect of this phase shifter is acceptable and reduces the phasiness of the rear signals substantially. As will be apparent to those skilled in the art, more complex multi-pole phase shifters could be used, but would require additional circuitry in all of the output channels, so it does not provide a cost-effective way of smoothly reversing the phase of the one rear channel where this is desired.

Figure 5B:
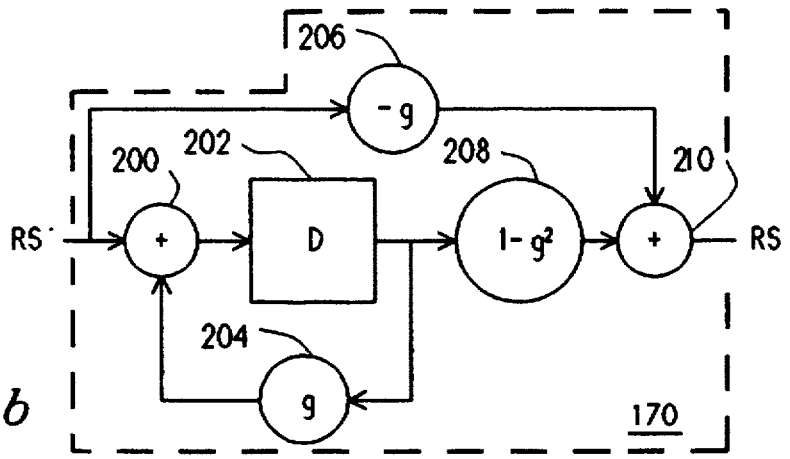

In FIG. 5*b* is shown a conventional variable digital delay element that may be used in implementing a digital embodiment of the delay block 170 of the circuit of FIG. 4. In this circuit, the gain value g is controlled by the value of control signal c/s so as to perform the same function as for the analog phase shifter of FIG. 5*a*. In this circuit, the signals applied to adder 200 are summed and delayed by delay block 202, the output of which is fed back through a multiplier 204 of gain g to one of the inputs of adder 200. The RS' signal is applied to the other input of adder 204 and also to multiplier 206, where it is multiplied by a coefficient −g. The output signal from delay block 202 is multiplied by $(1-g^2)$ in multiplier 208, and added to the signal from multiplier 206 in adder 210 to provide the RS signal at the output of adder 210.

While the performance of this phase shifter is not quite identical to that of its analog counterpart in FIG. 5*a*, it is sufficiently similar to provide the desired effect.

FIGS. 6*a* through 6*e* show graphically the variations of the various matrix coefficients of the decoder of FIG. 4 and its enhancements that are described by equations in the preceding section to the description of FIG. 4, for further clarification of the operation of this decoder.

Figure 6A:
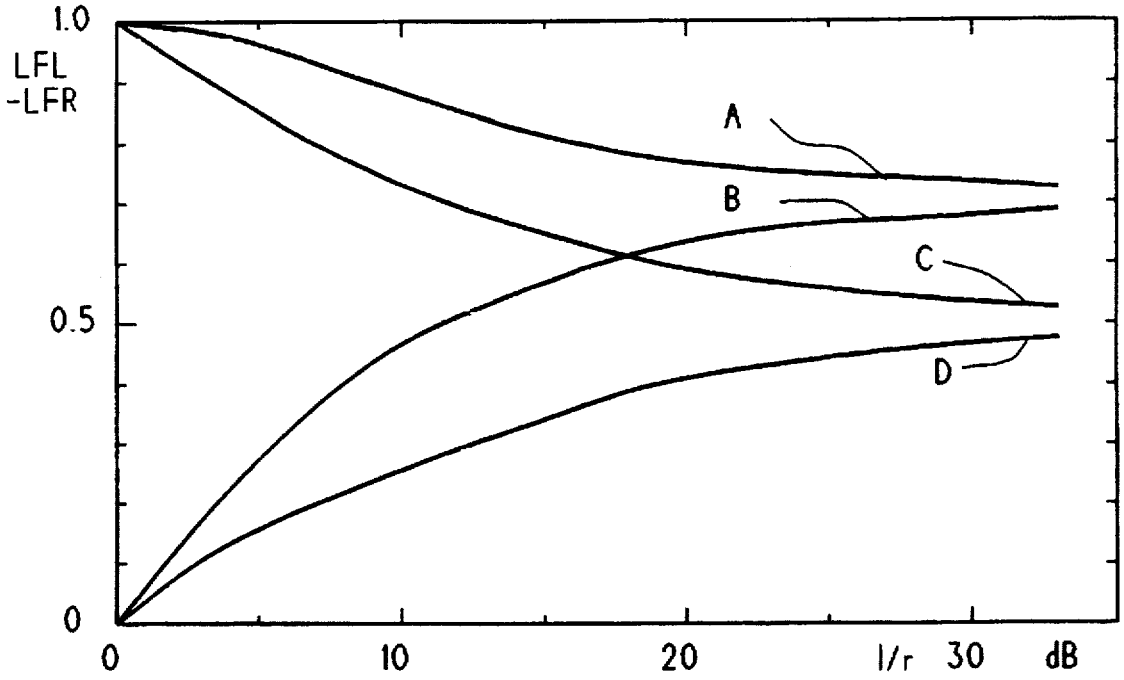
FIGS. 6*a*–6*e* show the relationships between various signals in the decoder of FIG. 4.

In FIG. 6*a*, the curves A and B represent the variation of coefficients LL (LFL) and −LR (−LFR) respectively as the value of c/s ranges from 0 dB to about 33 dB. These curves follow the sine—cosine law as derived in equations (27) and (28). The variation of RR (RFR) and RL (RFL) is similar in form for steering in the right front quadrant.

The curves C and D respectively show the corresponding values of LFL and LFR for the decoder according to the previous Greisinger U.S. Pat. No. 5,136,650 for comparison. In these curves, which approach the value 0.5 under strong center steering, the music component is 3 dB too low, hence the new decoder curves A and B which meet at 0.71 provide constant music level, while the old curves do not.

Figure 6B:
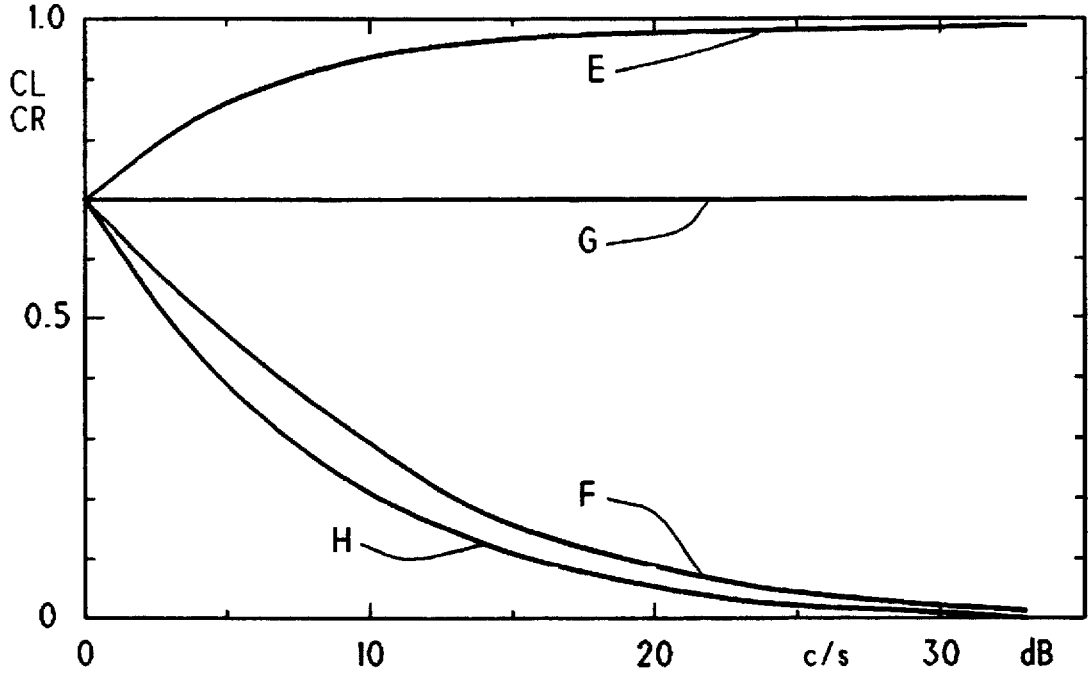

In FIG. 6*b* are shown the curves E and F representing the center coefficients CL and CR under l/r steering from center (0 dB) to left (33 dB). The left coefficient CL increases by 3 dB while the right coefficient CR decreases to zero as the steering moves to the left. Similar considerations apply but in the opposite sense when the steering is to the right.

The curves G and H represent CL and CR respectively in the decoder of Greisinger's previous patent referenced above, showing that again the music level is not maintained constant, as the curve G does not increase by the required 3 dB.

Figure 6C:
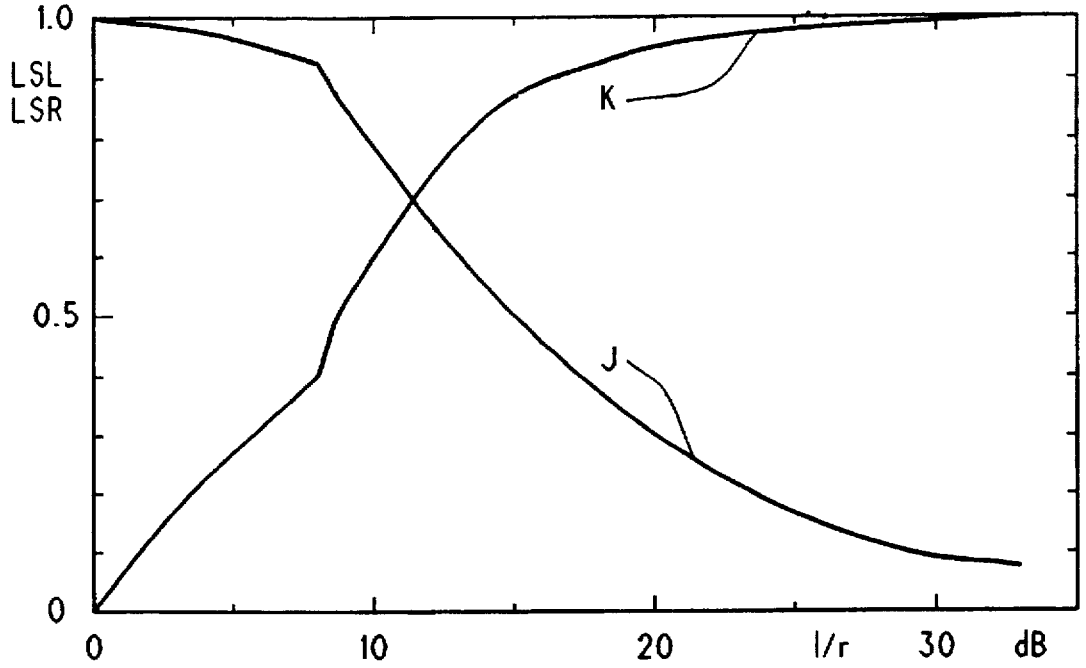

Turning to FIG. 6*c*, Curves J and K represent the values of the coefficients LSL and LSR during rear steering respectively as the ratio l/r goes from 0 dB (no steering or rear steering) to 33 dB, representing full left steering. The LSL curve J reduces to zero, as it is removing left signal from the left surround channel, while the LSR signal increases so that the level of the music remains constant in the room. It is clear from the curves that there is a break point at 8 dB, corresponding to a steering angle of 22.5° to the rear. Here the matrix elements must total (in r.m.s. fashion) to 1 when the input has only a directional signal. This is achieved if they have values of cos 22.5° or 0.92 and sin 22.5° or 0.38, as can be seen from the curves.

In this context, note that l/r can be zero dB either when the signal is steered fully rear, or when there is no steered component of the signal. In either case, the matrix relaxes to the full left-right separation that is desired.

Figure 6D:
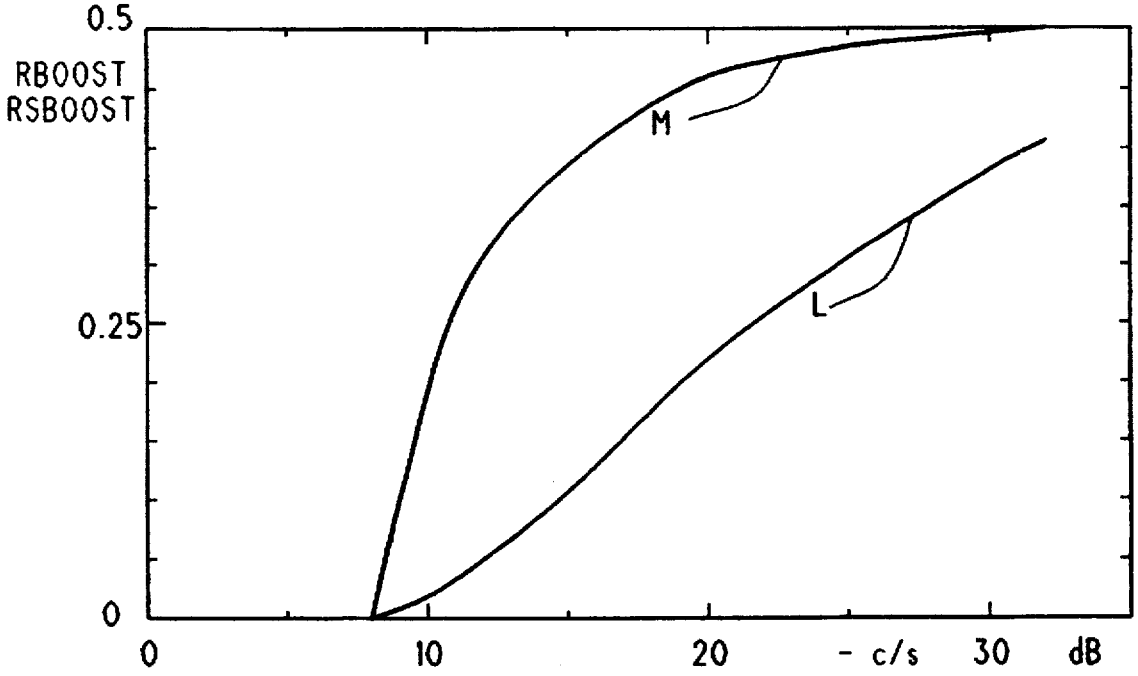

In FIG. 6*d*, the curve L represents the RBOOST value tabulated above in TABLE 1 and used in equations (76) and (79), and subsequently. The value of LSL is too small when steering to full rear, so the value of RBOOST is added to it to keep the music level constant. Only LSL is boosted, so complete separation is maintained. The value of RBOOST depends only on c/s, as c/s varies from −8 dB to −33 dB (full rear) i.e. the x-axis of the graph is −c/s, with c/s in dB.

Also shown in FIG. 6*d* is the curve M which represents the value of RSBOOST. In the seven-channel version of the decoder, this value is subtracted from the left side coefficient and half of it is added to the left rear component, when steering between left rear (−8 dB) to full rear (−33 dB). Again, the axis is −(c/s in dB), and this curve goes from zero to 0.5, as expressed in equation (80) above.

Figure 6E:
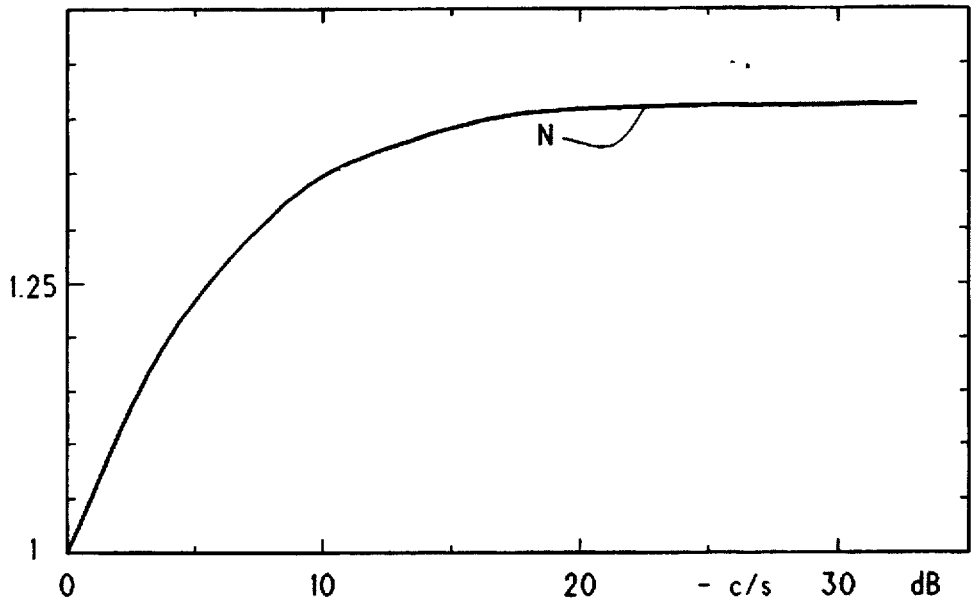

Finally, in FIG. 6*e* is shown the curve N which represents the variation of the correction factor (sin ts+cos ts) with the control signal c/s applied to the rear and side surround channels to keep the level of music constant, as described above subsequent to equation (39).

Turning to FIG. 7, there is shown an active encoder suitable for use in movie soundtrack encoding generally, and particularly with reference to the decoder embodiments presented above.

In FIG. 7, the same five signals LS, L, C, R and RS are applied to the correspondingly numbered terminals 62, 50, 52, 54, 64 respectively as in the encoder of FIG. 3. For each of these signals there is a corresponding level detector and logarithmic amplifier to provide signals proportional to the logarithms of the amplitudes of each of these signals. These elements are numbered 212–230. The logarithmic signals are respectively labeled lsl, ll, cl, rl and rsl, corresponding to the inputs LS, L, C, R and RS. These signal levels are then compared in a comparator block (not shown), whose action is described below.

Attenuators 254 and 256 attenuate the LS signal by factors of 0.53 and 0.83 respectively, and Attenuators 258 and 260 attenuate the RS signal by factors of 0.83 and 0.53 respectively.

Each of the five input signals passes through an all-pass phase shift network, the blocks labeled 232, 234, providing phase shift functions $\phi$ and $\phi$-90° respectively for the attenuated LS signal from attenuators 254 and 256 respectively, blocks 236, 238, and 240 providing the phase shift function $\phi$ to each of L, C and R signals respectively. A signal combiner 242 sums 0.38LS with −0.38RS to provide a center surround signal to phase shifter block 244, which has a phase shift function $\phi$. The phase shifter blocks 246 and 248 provide phase shift functions $\phi$-90° and $\phi$ respectively in the RS channel from attenuators 258 and 260 respectively.

A signal combining matrix 250 sums the LS($\phi$) signal attenuated by the attenuator 254, with gain sin $\theta_{LS}$, the LS($\phi$-90°) signal attenuated by the attenuator 256, with gain (cos $\theta_{LS}$), the L($\phi$) signal, the C($\phi$) signal with gain 0.707, and the surround signal S=(0.38LS−0.38RS) with phase $\phi$, which is labeled S($\phi$), to produce the left output signal A at terminal 44.

A similar matrix 252 sums the RS($\phi$) signal with gain sin $\theta_{RS}$, the RS($\phi$-90°) signal with gain (cos $\theta_{RS}$), the R($\phi$) signal, the C($\phi$) signal with gain 0.707, and the S($\phi$) signal, to produce the right output B at terminal 46.

The steering angles $\theta_{LS}$ and $\theta_{RS}$ are made dependent upon the log amplitude signals lsl, ll, cl, rl and rsl in the following manner in this embodiment of the invention:

Whenever lsl is larger than any of the remaining signals, then $\theta_{LS}$ approaches 90°, otherwise $\theta_{LS}$ approaches 0. These values may be extremes of a smooth curve. Similarly, if rsl is larger than any of the other signals, $\theta_{RS}$ approaches 90°, otherwise $\theta_{RS}$ approaches 0.

The particular advantage of this mode of operation is that when a signal is applied to the LS or RS input only, the output of the encoder is real, and produces an l/r ratio in the decoder of 2.41:1 (8 dB), which is the same value produced by the simplified encoder and the passive encoder.

Figure 8:
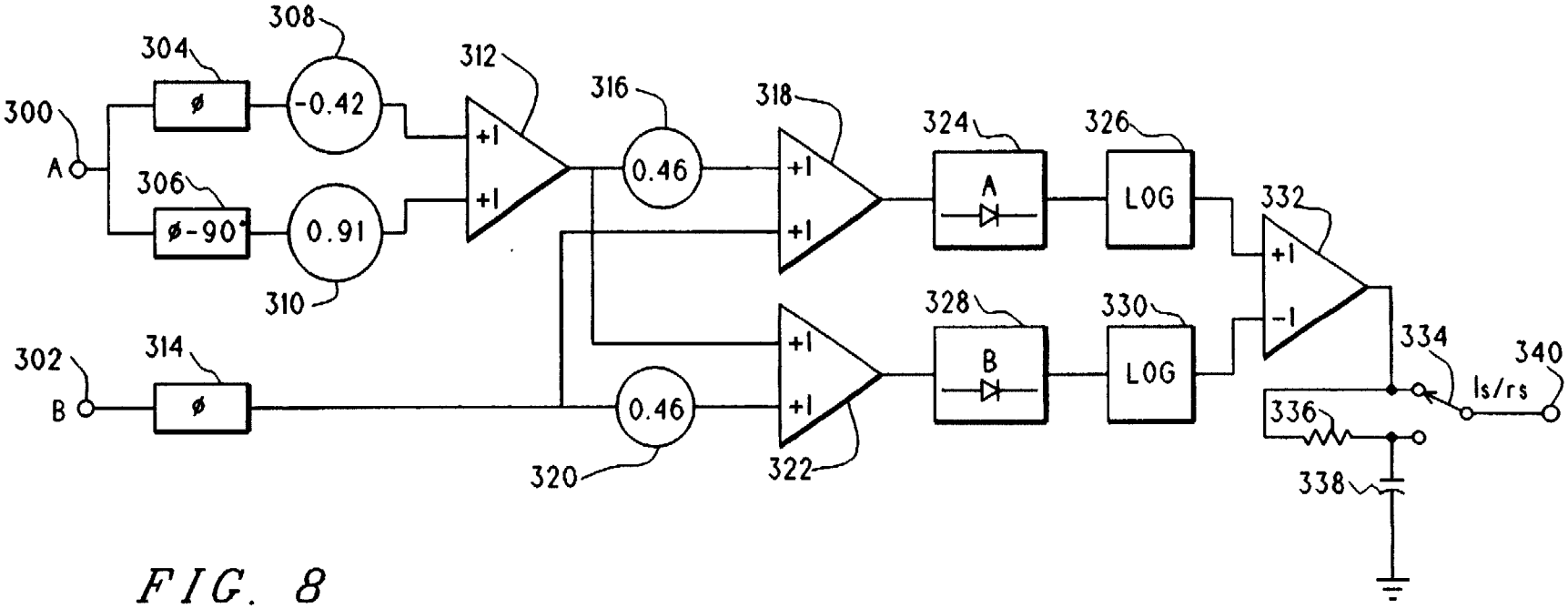
FIG. 8 shows a phase sensitive detection circuit for generation of an ls/rs signal for use with the phase correction circuit of FIG. 9.
Figure 9:
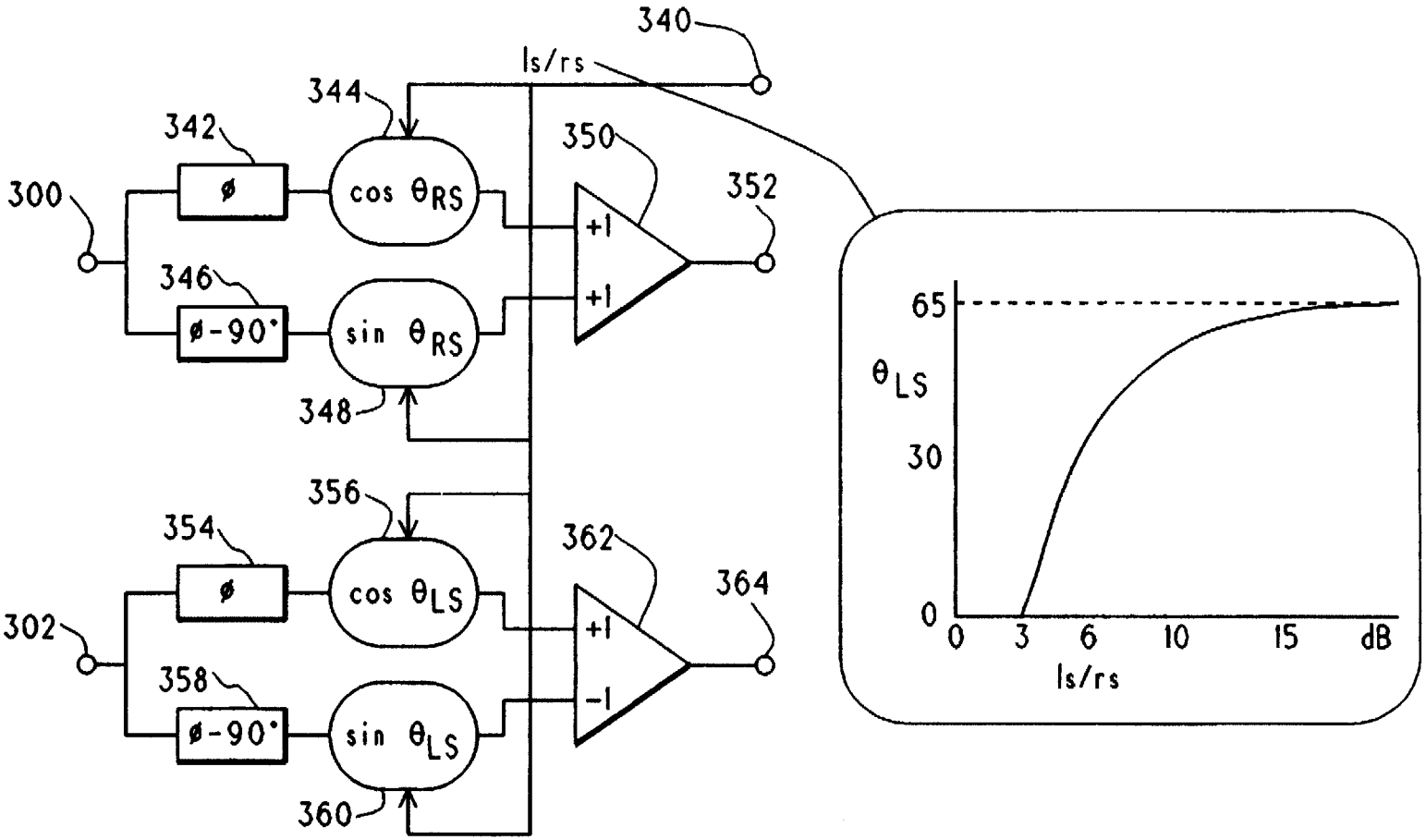
FIG. 9 shows an input phase correction circuit to be applied ahead of the decoder of FIG. 4 for optimal decoding of passively encoded movie soundtracks including a graph showing the relationship between the control signal ls/rs and the steering angle $\theta_{LS}$.

Turning to FIG. 8, which shows a part of a decoder according to the invention having complex rather than real coefficients in the matrix, the figure illustrates a method for generating a third control signal ls/rs (in addition to the signals l/r and c/s generated by the decoder in FIG. 4), which is used for varying the additional phase shift network of FIG. 9 that is placed ahead of the decoder of FIG. 4 in order to effect the generation of complex coefficients in the matrix.

It will be seen that the A and B signals are now applied to terminals 300 and 302 respectively, instead of to terminals 92 and 94 of FIG. 4. An all-pass phase shift network 304 having the phase function $\phi(f)$ of frequency $f$, and a second all-pass phase shift network 306 having the phase function $\phi(f)$-90° receive the A signal from terminal 300. The phase shifted signal from 304 is attenuated by a factor −0.42 in attenuator 308 and the lagging quadrature phase shifted signal from 306 is attenuated by the factor 0.91 in attenuator 310. The outputs of attenuators 308 and 310 are summed in summer 312.

The B signal at terminal 302 is passed through an all-pass phase shift network 314 so that the output of summer 312 is signal A shifted by 65° relative to signal B at the output of phase shifter 314.

The output of summer 312 is passed through attenuator 316 with an attenuation factor 0.46, and to one input of a summer 318, where it is added to the phase-shifted signal B from shifter 314. Similarly, the output of phase shifter 314 is attenuated by attenuator 320 with the same factor 0.46 and passed to summer 322 where it is added to the output of summer 312, the phase-shifted A signal. The particular choices of coefficients in attenuators 308, 310, 316 and 320 are made so that signals applied to the LS input only of the passive encoder will produce no output at the summer 308, and a signal applied to the RS input only will produce no output at the summer 322. The object thus is to design a circuit that will recognize as input of the decoder the case when the signal is only being applied to the left side or right side of the encoder. It does this by a cancellation technique, such that one or the other of the two signals goes to zero when the condition exists.

The output of summer 318 is passed into level detection circuit 324 and log amplifier 326, while the output of summer 322 is passed through level detector 328 and logarithmic amplifier 330. The outputs of log amplifiers 326 and 330. The outputs of log amplifiers 326 and 330 are passed to subtractor 332 which produces an output proportional to their log ratio. This output may be selected by switch 334, or the output from the R-C time constant formed by resistor 336 and capacitor 338, which have values identical to the corresponding components shown in FIG. 4, may alternatively be selected by switch 334 and passed to terminal 340 as the steering signal ls/rs.

Thus the signal ls/rs will be either a maximum positive value when a signal is applied to the LS input of the passive encoder, or a maximum negative value when a signal is applied to the RS input.

The purpose of the signal ls/rs is to control the input phases applied to the decoder of FIG. 4. For this reason, the network of FIG. 9 is interposed between the A and B signals applied to terminals 92 and 94 of FIG. 4.

The circuit shown in FIG. 9 includes a phase shifter 342 of phase function $\phi$, which is may be the same shifter as 304 in FIG. 8, followed by an attenuator 344 having the attenuation value cos $\theta_{RS}$, while the phase shifter 346, which may be the sam shifter as 306 in FIG. 8. of phase function $\phi$-90°, is passed through attenuator 348 with attenuation factor sin $\theta_{RS}$. The outputs of attenuators 344 and 348 are summed by summer 350 to provide a modified A signal at terminal 352, which is to be directly connected to terminal 92 of FIG. 4.

In the lower part of FIG. 9. the B signal is applied to terminal 302 as in FIG. 8, and in one branch passes through phase shifter 354 of phase function $\phi$ and attenuator 356 of attenuation factor cos $\theta_{LS}$, while in the other branch it passes through phase shifter 358 of phase function $\phi$-90° and attenuator 360 of attenuation factor sin $\theta_{LS}$. The signals from attenuators 356 and 360 are combined in subtractor 362 to provide a modified B signal at terminal 364, which is to be directly connected to the terminal 94 in FIG. 4. The result in the change in phase is to produce better separation between the LS and RS outputs of the decoder (as well as the LR and RR outputs in a 7-channel version) when only the LS or RS inputs of the passive encoder are being driven with signals.

Figure 10:
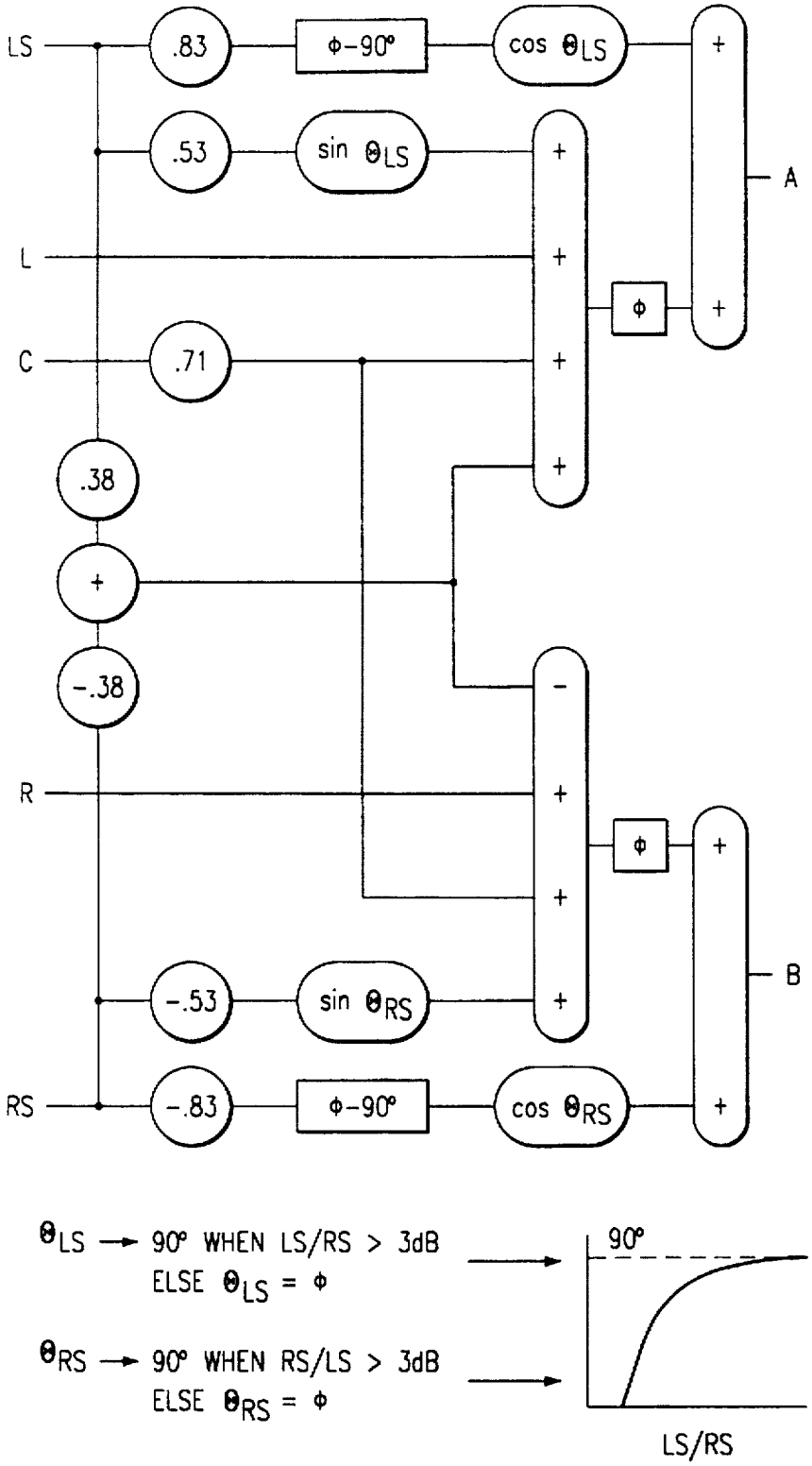
FIG. 10 shows a block schematic of a simplified active encoder according to the invention.

The relationship between the control signal ls/rs and the steering angle $\theta_{LS}$ is shown in the inset graph of FIG. 9. As ls/rs reached 3 dB, the angle $\theta_{LS}$ begins to change from 0° rising towards 65° at high values of ls/rs. An exactly complementary relationship applies to the other steering angle $\theta_{RS}$ which is controlled by the inverse of ls/rs, which we call rs/ls, so that when rs/ls exceeds 3 dB, the value of $\theta_{RS}$ begins to increase from 0°, moving towards an asymptote at −65° when rs/ls is at its maximum value. As $\theta_{LS}$ and $\theta_{RS}$ vary, the matrix coefficients effectively become complex due to the phase changes at the inputs to the main part of the decoder shown in FIG. 4. FIG. 10 illustrates an alternative embodiment of an encoder that differs from that of FIG. 7 by simplifying the phase shift networks. The number of phase shift networks can by reduced by combining the real signals before sending them through the $\phi$ phase shifter, thus resulting in only two $\phi$ and two $\phi$-90° phase shift networks. The description of $\theta_{LS}$ and $\theta_{RS}$ is also simplified. $\theta_{LS}$ approaches 90° when lsl/rsl is greater than 3 dB, and otherwise is zero (just as in the decoder design). Likewise, $\theta_{RS}$ approaches 90° when rsl/lsl is greater than 3 dB, and otherwise is zero.

While the preferred embodiments of the invention have been described herein, many other possible embodiments exist, and these and other modifications and variations will be apparent to those skilled in the art, without departing from the spirit of the invention.

What is claimed is:

1. A surround sound decoder for redistributing a pair of left and right audio input signals including directionally encoded and non-directional components into a plurality of output channels for reproduction through loudspeakers surrounding a listening area, and incorporating circuitry for determining the directional content of the left and right audio signals and generating therefrom at least a left-right steering signal and center-surround steering signal, the decoder comprising:

delay means for delaying each of said left and right audio input signals to provide delayed left and right audio signals;

a plurality of multiplier means equal to twice the number of said plurality of output channels, organized in pairs, a first element of each said pair receiving said delayed left audio signal and a second element receiving said delayed right audio signal, each of said multiplier means multiplying its input audio signal by a variable matrix coefficient to provide an output signal;

said variable matrix coefficient being controlled by one or both of said steering signals; and a plurality of summing means one for each of said plurality of output channels each said summing means receiving the output signals of a pair of said multiplier means and producing at its output one of said plurality of output signals, the decoder having said variable matrix values so constructed as to reduce directionally encoded audio components in outputs which are not directly involved in reproducing them in the intended direction; enhance directionally encoded audio components in the outputs which are directly involved in reproducing them in the intended direction so as to maintain constant total power for such signals; while preserving high separation between the left and right channel components of non-directional signals regardless of the said steering signals; and maintaining the loudness defined as the total audio power level of non-directional signals effectively constant whether or not directionally encoded signals are present and regardless of their intended direction if present.

2. The decoder of claim 1 wherein said plurality of output channels is five, namely left, center, right, left surround and right surround.

3. The decoder of claim 2 wherein a variable phase shifter is further provided in series with the said right surround output channel, controlled by said center-surround steering signal, so as to change the relative phase of the said left surround and right surround signals progressively as said steering signal changes to full rear to be in phase when said steering signal represents a full rear directionally encoded input wherein said left and right audio input signals are fully correlated, equal in amplitude, and in antiphase.

4. The decoder of claim 1 wherein said plurality of output channels is seven, namely left, center, right, left side, right side, left rear and right rear.

5. The decoder of claim 4 wherein a variable phase shifter is further provided in series with each of said right side and right rear output channels, said phase-shifters being controlled by said center-surround steering signal, so as to change the relative phase of the said left side and right side output signals, and said left rear and right rear output signals, progressively as said steering signal changes to full rear, to be in phase when said steering signal represents a full rear directionally encoded input wherein said left and right audio input signals are fully correlated, equal in amplitude, and in antiphase.

6. The decoder of claim 1 wherein said variable matrix coefficients are varied in such a manner that the sum of the squares of the left and right matrix coefficients in each said pair of multiplier means is made one regardless of the changes in their values needed to cancel unwanted directional components, thereby maintaining the loudness of non-directional signals constant.

7. The decoder of claim 1 wherein said variable matrix coefficients are such that for a directionally encoded input signal in the absence of non-directional components, the change in output level of adjacent outputs approximates a sine/cosine relationship following the intended direction of the encoded signal with complete cancellation in non-adjacent outputs, thereby reproducing the directionally encoded signal in the intended direction and without changing the apparent loudness of the signal as its intended direction varies.

8. The decoder of claim 1 wherein said variable matrix coefficients are so constructed as to boost the non cross matrix elements for the front channels by 3 dB when a signal is directed toward a front output, namely left, center or right, to make the decoder outputs compatible with an existing standard for film soundtrack decoding.

9. The decoder of claim 2 wherein said variable matrix coefficients for said center output are controlled by said left-right steering signal, said variable matrix coefficients for said left and right outputs are controlled by said center-surround steering signal, and said left and right surround outputs are controlled by both said steering signals.

10. The decoder of claim 4 wherein said variable matrix coefficients for said center output are controlled by said left-right steering signal, said variable matrix coefficients for said left and right outputs are controlled by said center-surround steering signal, and said left and right side and rear outputs are controlled by both said steering signals.

11. The decoder of claim 2 wherein said variable matrix coefficients for said left and right surround channels include a rear boost component whenever the steered direction is between left rear and right rear, to maintain the directional component of the input signals at a constant level while increasing the level of non-directional signals by not more than 3 dB.

12. The decoder of claim 4 wherein said variable matrix coefficients for said left and right rear channels include a rear boost component which is added to the left and right surround non cross matrix elements whenever the steered direction is between left rear and right rear, to maintain the directional component of the input signals at a constant level while increasing the level of non-directional signals by not more than 3 dB.

13. The decoder of claim 4 wherein said variable matrix coefficients for said left and right side and rear channels include a rear side boost component which is subtracted from the left and right side non cross matrix elements and added to the left and right rear non cross matrix elements in proportions which cause the apparent direction of the steered sound to move smoothly to the rear while maintaining constant loudness as the intended direction changes from left side through full rear to right side.

14. The decoder of claim 2 wherein said center output is not delivered to a loudspeaker and said left and right variable matrix coefficients are compensated by an added boost factor in the non cross matrix elements which is dependent on the said center-surround steering signal, so as to provide the center directional signal to both left and right outputs at the correct levels while maintaining full separation for non-directional signals.

15. The decoder of claim 4 wherein said center output is not delivered to a loudspeaker and said left and right variable matrix coefficients are compensated by an added boost factor in the non cross matrix elements which is dependent on the said center-surround steering signal, so as to provide the center directional signal to both left and right outputs at the correct levels while maintaining full separation for non-directional signals.

16. The decoder of claim 1 wherein all said components comprise analog circuit elements.

17. The decoder of claim 1 wherein all said components are components of a digital signal processing algorithm executed by a digital signal processor.

18. A passive encoder for application ahead of a standard film soundtrack encoder having left, center, right and surround inputs and left and right outputs for providing thereto correctly encoded left, center, right, left surround and right surround input signals such that said signals when encoded onto two audio channels by said standard film soundtrack encoder will be correctly decoded by any active decoder having characteristics so as to reduce directionally encoded audio components in outputs which are not directly involved in reproducing them in the intended direction, enhance directionally encoded audio components in the outputs which are directly involved in reproducing them in the intended direction so as to maintain constant total power for such signals, while preserving high separation between the left and right channel components of non-directional signals regardless of the said steering signals.

19. The encoder means of claim 18 comprising:

left surround, left, center, right and right surround input terminals for receiving corresponding audio signals;

first, second, third, fourth and fifth all-pass phase shift networks connected respectively to said left surround, left, center, right and right surround signal input terminals, said second, third and fourth phase shift networks providing a phase shift that is a function $\phi(f)$ of frequency $f$, and said first and fifth phase shift networks providing a phase shift that is a function $\phi(f)$-90°, lagging the phase of correlated signals in said left, center or right inputs by 90°;

a first signal combiner for combining approximately 0.83 times the output of said left surround phase shift network with 1 times the output of said left phase shift network;

a second signal combiner for combining approximately minus 0.83 times the output of said right surround phase shift network with 1 times the output of said right phase shift network;

a third signal combiner for combining approximately minus 0.53 times the output of said left surround phase shift network with approximately 0.53 times the output of said right surround phase shift network;

said first signal combiner providing at its output a signal for application to the left input of said standard film soundtrack encoder;

said second signal combiner providing at its output a signal for application to the right input of said standard film soundtrack encoder;

said third phase shift network providing at its output a signal for application to the center input of said standard film encoder; and said third signal combiner providing at its output a signal for application to the surround input of said standard film encoder.

20. An active encoder means for receiving left surround, left, center, right and right surround inputs and generating composite left and right audio outputs compatible with those provided by standard film soundtrack encoders, comprising:

first, second, third, fourth and fifth audio input terminals for receiving said left surround, left, center, right and right surround input signals;

first, second, third, fourth and fifth signal detection means for providing direct voltages proportional to the amplitudes of the signals present at said first, second, third, fourth and fifth input terminals, and connected thereto;

first, second, third, fourth and fifth logarithmic amplifier means for receiving said direct voltages from the corresponding ones of said signal detection means and providing at their outputs direct voltages proportional to the logarithms of their input signals;

first and second attenuator means for attenuating said left surround signal by factors of 0.53 and 0.83 respectively;

first and second all-pass phase shifter means having phase shift functions $\phi(f)$ and $\phi(f)$-90° respectively for receiving said attenuated left surround signal from said first and second attenuator means respectively;

third, fourth and fifth phase shifter means having a phase shift function $\phi(f)$ for receiving respectively said left, center and right input signals;

third and fourth attenuator means for attenuating said right surround signal by factors of 0.83 and 0.53 respectively;

sixth and seventh all-pass phase shifter means having phase shift functions $\phi(f)$ and $\phi(f)$-90° respectively for receiving said attenuated right surround signal from said third and fourth attenuator means respectively;

first signal combiner means for combining approximately 0.38 times said left surround input signal with approximately minus 0.38 times said right surround input signal;

eighth all-pass phase shifter means having a phase shift function $\phi(f)$ for receiving the output of said first signal combiner means;

second signal combiner means for receiving the outputs of said first, second, third, fourth and eighth all-pass phase shifter means in proportions $\sin\theta_{LS}$, $\cos\theta_{LS}$ 1, 0.71 and 1 respectively, to provide said composite left output signal;

third signal combiner means for receiving the outputs of said eighth, fourth, fifth, seventh and sixth all-pass phase shifter means in proportions −1, 0.71, 1, $\sin\theta_{LS}$, and $\cos\theta_{LS}$ respectively, to provide said composite right output signal;

first signal comparing means for comparing the outputs of said first logarithmic amplifier means with the largest of the outputs of said second, third, fourth and fifth logarithmic means, and for varying the steering angle $\theta_{LS}$ employed in said second signal combiner means such that when the output of said first logarithmic amplifier means exceeds that of any of the remaining said logarithmic amplifier means the value of steering angle $\theta_{LS}$ tends to 45°, and when the output of said first logarithmic amplifier means is less than that of one or more of the remaining logarithmic amplifier means the value of steering angle $\theta_{LS}$ tends to 90°; and second signal comparing means for comparing the outputs of said fifth logarithmic amplifier means with the largest of the outputs of said second, third, fourth and first logarithmic means, and for varying the steering angle $\theta_{RS}$ employed in said third signal combiner means such that when the output of said fifth logarithmic amplifier means exceeds that of any of the remaining said logarithmic amplifier means the value of steering angle $\theta_{RS}$ tends to 45°, and when the output of said fifth logarithmic amplifier means is less than that of one or more of the remaining logarithmic amplifier means the value of steering angle $\theta_{RS}$ tends to 90°.

21. The decoder of claim 2 or 4 further comprising detector means for detecting the phase characteristics of left surround and/or right surround signals encoded using a passive encoder and phase corrector means interposed between the left and right composite audio signals provided to said decoder means and the corresponding input terminals thereof and controlled by the output of said detector means for modifying the phase of either the composite left input signal or the composite right input signal provided to the aforesaid decoder, such that when a pure left surround or right surround signal is present at the inputs of said phase corrector means, the signals from the said phase corrector means are in an amplitude ratio of approximately 2.41:1 and in antiphase, thereby causing the said decoder to produce an output signal only at its left surround or right surround output, respectively.

22. The decoder of claim 21 wherein said additional detector means comprises:

means for generating from the composite left audio input signal and the composite right audio input signal a corresponding pair of signals having a 65° phase difference at all frequencies;

first and second signal combining means for combining the said left and right phase shifted signals in proportions of 1:0.46 and 0.46:1 respectively;

first and second level detection means for providing a voltage proportional to the relative levels of the outputs of said first and second signal combining means; and subtractor means for differencing the output signals of said first and second level detection means.

23. The decoder of claim 21 wherein said phase correction means comprises:

first and second all pass phase shift networks for receiving said left composite audio input signal and providing a pair of related signals which are in quadrature phase relationship at all audio frequencies, the phase of said second all pass network lagging that of the first network;

first and second attenuator means for attenuating the outputs of said first and second phase shift networks respectively by factors of $\cos \theta_{RS}$ and $\sin \theta_{RS}$ where $\theta_{RS}$ is a steering angle computed from the output of said additional detector means;

signal summing means for summing the outputs of said first and second attenuator means, to provide a said modified left composite audio signal to the left audio input terminal of said decoder means;

third and fourth all pass phase shift networks for receiving said right composite audio input signal and providing a pair of related signals which are in quadrature phase relationship at all audio frequencies, the phase of said second all pass network lagging that of the first network;

third and fourth attenuator means for attenuating the outputs of said third and fourth phase shift networks respectively by factors of $\cos \theta_{LS}$ and $\sin \theta_{LS}$ where $\theta_{LS}$ is a settering angle computed from the output of said additional detector means; and subtractor means for subtracting the output of said fourth attenuator means from that of said third attenuator means, to provide a said modified right composite audio signal to the right audio input terminal of said decoder means;

wherein said steering angle $\theta_{LS}$ varies from 0° to approximately 65° as the output of said additional detector means varies from +3 dB relative level to large positive values, remaining at 0° when the level difference is less than 3 dB, and said steering angle $\theta_{RS}$ varies from 0° to −65° as the output of said additional detector means varies from −3 dB to large negative values, remaining at 0° when the level difference is less negative than −3 dB.

24. Apparatus for converting stereophonic audio input signals on two channels into a plurality of output channels for multichannel sound reproduction through power amplification in a like plurality of loudspeakers surrounding a listening area, said stereophonic audio signals containing at least one component producing correlated audio signals in the two channels and other components which are uncorrelated, said correlated signal component possibly but not necessarily having been directionally encoded through a four or five channel phase and amplitude encoding device, said apparatus including means for determining the directional encoding attributable to said correlated component of said input signals and producing a number of directional control signals responsive thereto, means for delaying said audio input signals by a fixed time delay, and a decoding matrix means for combining each or both of said stereophonic input signals in various proportions suitable for reproduction one each of said plurality of loudspeakers, according to real or complex coefficients responsive to one or more of said directional control signals, so as to enhance the directionally encoded component of said audio input signals in the audio output channels nearest to that direction and to remove it from all remaining audio output channels, while preserving the total loudness of said directionally encoded component constant and also preserving the total loudness of said uncorrelated components of said audio input signals, and maintaining full left to right separation of said uncorrelated audio input signal components regardless of the encoded direction of said directionally encoded component thereof.

* * * * *